US010096921B2

(12) United States Patent
Johnescu et al.

(10) Patent No.: US 10,096,921 B2
(45) Date of Patent: Oct. 9, 2018

(54) ELECTRICAL CONNECTOR HAVING RIBBED GROUND PLATE

(71) Applicant: FCI USA LLC, Etters, PA (US)

(72) Inventors: Douglas M. Johnescu, York, PA (US); Jonathan E. Buck, Hershey, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/283,341

(22) Filed: Oct. 1, 2016

(65) Prior Publication Data

US 2017/0025774 A1 Jan. 26, 2017

Related U.S. Application Data

(63) Continuation of application No. 14/339,769, filed on Jul. 24, 2014, now Pat. No. 9,461,410, which is a (Continued)

(51) Int. Cl.
*H01R 13/648* (2006.01)
*H01R 12/73* (2011.01)

(Continued)

(52) U.S. Cl.
CPC ..... *H01R 12/737* (2013.01); *H01R 12/724* (2013.01); *H01R 13/514* (2013.01);

(Continued)

(58) Field of Classification Search
CPC ..... H01R 23/688; H01R 23/7073; H01R 23/6873; H01R 13/514; H01R 13/65807; H01R 13/518

(Continued)

(56) References Cited

U.S. PATENT DOCUMENTS 318,186 A 5/1885 Hertzog
741,052 A 10/1903 Mahon (Continued)

FOREIGN PATENT DOCUMENTS

DE 4040551 A1 6/1991
DE 102010005001 A1 8/2010
EP 0442785 A1 8/1991

OTHER PUBLICATIONS

International Application No. PCT/US2003/014370, International Search Report dated Aug. 6, 2003.

(Continued)

*Primary Examiner* — Hien Vu
(74) *Attorney, Agent, or Firm* — Wolf, Greenfield & Sacks, P.C.

(57) ABSTRACT

An electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs. The signal contacts further define respective mating and mounting ends. The ground plate includes a ground plate body oriented in a second plane that is substantially parallel to the first plane and offset from the first plane. The ground plate body defines first and second opposed surfaces. The ground plate includes at least one rib that defines first and second opposed surfaces, wherein the first surface of the rib projects from the first surface of the ground plate body in a direction toward the first plane between adjacent signal pairs, and the second surface is recessed into the second surface of the ground plate body.

18 Claims, 11 Drawing Sheets

Related U.S. Application Data continuation of application No. 13/755,628, filed on Jan. 31, 2013, now Pat. No. 9,048,583, which is a continuation of application No. 12/722,797, filed on Mar. 12, 2010, now Pat. No. 8,366,485.

(60) Provisional application No. 61/161,687, filed on Mar. 19, 2009.

(51) Int. Cl.

| | |
|---|---|
| ***H01R 13/514*** | (2006.01) |
| ***H01R 12/72*** | (2011.01) |
| ***H01R 13/6474*** | (2011.01) |
| ***H01R 13/6586*** | (2011.01) |
| ***H01R 43/18*** | (2006.01) |
| ***H01R 13/6587*** | (2011.01) |

(52) U.S. Cl.
CPC ..... *H01R 13/648* (2013.01); *H01R 13/6474* (2013.01); *H01R 13/6586* (2013.01); *H01R 13/6587* (2013.01); *H01R 43/18* (2013.01); *Y10T 29/49204* (2015.01); *Y10T 29/49208* (2015.01)

(58) Field of Classification Search
USPC ..... 439/607.06, 607.07, 607.09, 108
See application file for complete search history.

(56) References Cited

U.S. PATENT DOCUMENTS

| | | | |
|---|---|---|---|
| 1,477,527 | A | 12/1923 | Raettig |
| D86,515 | S | 3/1932 | Cox |
| 2,231,347 | A | 2/1941 | Reutter |
| 2,248,675 | A | 7/1941 | Huppert |
| 2,430,011 | A | 11/1947 | Gillentine |
| 2,664,552 | A | 12/1953 | Ericsson et al. |
| 2,759,163 | A | 8/1956 | Ustin et al. |
| 2,762,022 | A | 9/1956 | Benander et al. |
| 2,844,644 | A | 7/1958 | Soule, Jr. |
| 2,849,700 | A | 8/1958 | Perkin |
| 2,858,372 | A | 10/1958 | Kaufman |
| 3,011,143 | A | 11/1961 | Dean |
| 3,115,379 | A | 12/1963 | McKee |
| 3,178,669 | A | 4/1965 | Roberts |
| 3,179,738 | A | 4/1965 | De Lyon |
| 3,208,030 | A | 9/1965 | Evans et al. |
| 3,286,220 | A | 11/1966 | Marley et al. |
| 3,320,658 | A | 5/1967 | Bolda et al. |
| 3,343,120 | A | 9/1967 | Whiting |
| 3,366,729 | A | 1/1968 | Pauza |
| 3,411,127 | A | 11/1968 | Adams |
| 3,420,087 | A | 1/1969 | Hatfield et al. |
| D213,697 | S | 4/1969 | Oxley |
| 3,482,201 | A | 12/1969 | Schneck |
| 3,514,740 | A | 5/1970 | Filson et al. |
| 3,538,486 | A | 11/1970 | Shlesinger, Jr. |
| 3,560,908 | A | 2/1971 | Dell et al. |
| 3,591,834 | A | 7/1971 | Kolias |
| 3,634,811 | A | 1/1972 | Teagno et al. |
| 3,641,475 | A | 2/1972 | Irish et al. |
| 3,663,925 | A | 5/1972 | Proctor |
| 3,669,054 | A | 6/1972 | Desso et al. |
| 3,692,994 | A | 9/1972 | Hirschman et al. |
| 3,701,076 | A | 10/1972 | Irish |
| 3,719,981 | A | 3/1973 | Steitz |
| 3,732,697 | A | 5/1973 | Dickson |
| 3,748,633 | A | 7/1973 | Lundergan |
| 3,827,005 | A | 7/1974 | Friend |
| 3,845,451 | A | 10/1974 | Neidecker |
| 3,864,004 | A | 2/1975 | Friend |
| 3,865,462 | A | 2/1975 | Cobaugh et al. |
| 3,867,008 | A | 2/1975 | Gartland, Jr. |
| 3,871,015 | A | 3/1975 | Lin et al. |
| 3,889,364 | A | 6/1975 | Krueger |
| 3,942,856 | A | 3/1976 | Mindheim et al. |
| 3,972,580 | A | 8/1976 | Pemberton et al. |
| 4,030,792 | A | 6/1977 | Fuerst |
| 4,056,302 | A | 11/1977 | Braun et al. |
| 4,070,088 | A | 1/1978 | Vaden |
| 4,076,362 | A | 2/1978 | Ichimura |
| 4,082,407 | A | 4/1978 | Smorzaniuk et al. |
| 4,097,266 | A | 6/1978 | Takahashi et al. |
| 4,136,919 | A | 1/1979 | Howard et al. |
| 4,140,361 | A | 2/1979 | Sochor |
| 4,159,861 | A | 7/1979 | Anhalt |
| 4,217,024 | A | 8/1980 | Aldridge et al. |
| 4,232,924 | A | 11/1980 | Kline et al. |
| 4,260,212 | A | 4/1981 | Ritchie et al. |
| 4,274,700 | A | 6/1981 | Keglewitsch et al. |
| 4,288,139 | A | 9/1981 | Cobaugh et al. |
| 4,371,912 | A | 2/1983 | Guzik |
| 4,380,518 | A | 4/1983 | Wydro, Sr. |
| 4,383,724 | A | 5/1983 | Verhoeven |
| 4,395,086 | A | 7/1983 | Marsh |
| 4,396,140 | A | 8/1983 | Jaffe et al. |
| 4,402,563 | A | 9/1983 | Sinclair |
| 4,403,821 | A | 9/1983 | Zimmerman, Jr. et al. |
| 4,448,467 | A | 5/1984 | Weidler |
| 4,462,534 | A | 7/1984 | Bitaillou et al. |
| 4,464,003 | A | 8/1984 | Goodman et al. |
| 4,473,113 | A | 9/1984 | Whitfield et al. |
| 4,473,477 | A | 9/1984 | Beall |
| D275,849 | S | 10/1984 | Sakurai |
| 4,482,937 | A | 11/1984 | Berg |
| 4,505,529 | A | 3/1985 | Barkus |
| 4,523,296 | A | 6/1985 | Healy, Jr. |
| 4,533,187 | A | 8/1985 | Kirkman |
| 4,536,955 | A | 8/1985 | Gudgeon |
| 4,545,610 | A | 10/1985 | Lakritz et al. |
| 4,552,425 | A | 11/1985 | Billman |
| 4,560,222 | A | 12/1985 | Dambach |
| 4,564,259 | A | 1/1986 | Vandame |
| 4,592,846 | A | 6/1986 | Metzger et al. |
| 4,596,428 | A | 6/1986 | Tengler |
| 4,596,433 | A | 6/1986 | Oesterheld et al. |
| 4,624,604 | A | 11/1986 | Wagner et al. |
| 4,632,476 | A | 12/1986 | Schell |
| 4,641,426 | A | 2/1987 | Hartman et al. |
| 4,655,515 | A | 4/1987 | Hamsher, Jr. et al. |
| 4,664,309 | A | 5/1987 | Allen et al. |
| 4,664,456 | A | 5/1987 | Blair et al. |
| 4,664,458 | A | 5/1987 | Worth |
| 4,678,250 | A | 7/1987 | Romine et al. |
| 4,685,886 | A | 8/1987 | Denlinger et al. |
| 4,705,205 | A | 11/1987 | Allen et al. |
| 4,705,332 | A | 11/1987 | Sadigh-Behzadi |
| 4,717,360 | A | 1/1988 | Czaja |
| 4,722,470 | A | 2/1988 | Johary |
| 4,762,500 | A | 8/1988 | Dola et al. |
| 4,767,344 | A | 8/1988 | Noschese |
| 4,776,803 | A | 10/1988 | Pretchel et al. |
| 4,782,893 | A | 11/1988 | Thomas |
| 4,790,763 | A | 12/1988 | Weber et al. |
| 4,806,107 | A | 2/1989 | Arnold et al. |
| 4,815,987 | A | 3/1989 | Kawano et al. |
| 4,818,237 | A | 4/1989 | Weber |
| 4,820,169 | A | 4/1989 | Weber et al. |
| 4,820,182 | A | 4/1989 | Harwath et al. |
| 4,824,383 | A | 4/1989 | Lemke |
| 4,830,264 | A | 5/1989 | Bitaillou et al. |
| 4,836,791 | A | 6/1989 | Grabbe et al. |
| 4,844,813 | A | 7/1989 | Helfgott et al. |
| 4,846,727 | A | 7/1989 | Glover et al. |
| 4,850,887 | A | 7/1989 | Sugawara |
| 4,854,899 | A | 8/1989 | Matthews |
| 4,867,713 | A | 9/1989 | Ozu et al. |
| 4,871,110 | A | 10/1989 | Fukasawa et al. |
| 4,878,611 | A | 11/1989 | LoVasco et al. |
| 4,881,905 | A | 11/1989 | Demler, Jr. et al. |
| 4,882,554 | A | 11/1989 | Akaba et al. |
| 4,884,335 | A | 12/1989 | McCoy et al. |
| 4,898,539 | A | 2/1990 | Glover et al. |

(56) References Cited

U.S. PATENT DOCUMENTS

| | | | |
|---|---|---|---|
| 4,900,271 | A | 2/1990 | Colleran et al. |
| 4,904,212 | A | 2/1990 | Durbin et al. |
| 4,907,990 | A | 3/1990 | Bertho et al. |
| 4,908,129 | A | 3/1990 | Finsterwalder et al. |
| 4,913,664 | A | 4/1990 | Dixon et al. |
| 4,915,641 | A | 4/1990 | Miskin et al. |
| 4,917,616 | A | 4/1990 | Demler, Jr. et al. |
| 4,952,172 | A | 8/1990 | Barkus et al. |
| 4,963,102 | A | 10/1990 | Gettig et al. |
| 4,965,699 | A | 10/1990 | Jorden et al. |
| 4,973,257 | A | 11/1990 | Lhotak |
| 4,973,271 | A | 11/1990 | Ishizuka et al. |
| 4,974,119 | A | 11/1990 | Martin |
| 4,975,069 | A | 12/1990 | Fedder et al. |
| 4,975,084 | A | 12/1990 | Fedder et al. |
| 4,979,074 | A | 12/1990 | Morley et al. |
| 4,997,390 | A | 3/1991 | Scholz et al. |
| 5,004,426 | A | 4/1991 | Barnett |
| 5,016,968 | A | 5/1991 | Hammond et al. |
| 5,024,372 | A | 6/1991 | Altman et al. |
| 5,024,610 | A | 6/1991 | French et al. |
| 5,035,631 | A | 7/1991 | Piorunneck et al. |
| 5,035,639 | A | 7/1991 | Kilpatrick et al. |
| 5,046,960 | A | 9/1991 | Fedder |
| 5,052,953 | A | 10/1991 | Weber |
| 5,055,054 | A | 10/1991 | Doutrich |
| 5,060,844 | A | 10/1991 | Behun et al. |
| 5,065,282 | A | 11/1991 | Polonio |
| 5,066,236 | A | 11/1991 | Broeksteeg |
| 5,077,893 | A | 1/1992 | Mosquera et al. |
| 5,082,459 | A | 1/1992 | Billman et al. |
| 5,083,238 | A | 1/1992 | Bousman |
| 5,093,986 | A | 3/1992 | Mandai et al. |
| 5,094,623 | A | 3/1992 | Scharf et al. |
| 5,094,634 | A | 3/1992 | Dixon et al. |
| 5,098,311 | A | 3/1992 | Roath et al. |
| 5,104,332 | A | 4/1992 | McCoy |
| 5,104,341 | A | 4/1992 | Gilissen et al. |
| 5,111,991 | A | 5/1992 | Clawson et al. |
| 5,117,331 | A | 5/1992 | Gebara |
| 5,118,027 | A | 6/1992 | Braun et al. |
| 5,120,237 | A | 6/1992 | Fussell |
| 5,127,839 | A | 7/1992 | Korsunsky et al. |
| 5,131,871 | A | 7/1992 | Banakis et al. |
| 5,137,959 | A | 8/1992 | Block et al. |
| 5,139,426 | A | 8/1992 | Barkus et al. |
| 5,145,104 | A | 9/1992 | Apap et al. |
| 5,151,056 | A | 9/1992 | McClune |
| 5,152,700 | A | 10/1992 | Bogursky et al. |
| 5,161,987 | A | 11/1992 | Sinisi |
| 5,163,337 | A | 11/1992 | Herron et al. |
| 5,163,849 | A | 11/1992 | Fogg et al. |
| 5,167,528 | A | 12/1992 | Nishiyama et al. |
| 5,169,337 | A | 12/1992 | Ortega et al. |
| 5,174,770 | A | 12/1992 | Sasaki et al. |
| 5,181,855 | A | 1/1993 | Mosquera et al. |
| 5,194,480 | A | 3/1993 | Block et al. |
| 5,199,885 | A | 4/1993 | Korsunsky et al. |
| 5,203,075 | A | 4/1993 | Angulas et al. |
| 5,207,372 | A | 5/1993 | Funari et al. |
| 5,213,868 | A | 5/1993 | Liberty et al. |
| 5,214,308 | A | 5/1993 | Nishiguchi et al. |
| 5,217,381 | A | 6/1993 | Zell et al. |
| 5,222,649 | A | 6/1993 | Funari et al. |
| 5,224,867 | A | 7/1993 | Ohtsuki et al. |
| 5,228,864 | A | 7/1993 | Fusselman et al. |
| 5,229,016 | A | 7/1993 | Hayes et al. |
| 5,238,414 | A | 8/1993 | Yaegashi et al. |
| 5,254,012 | A | 10/1993 | Wang |
| 5,255,839 | A | 10/1993 | da Costa Alves et al. |
| 5,257,941 | A | 11/1993 | Lwee et al. |
| 5,261,155 | A | 11/1993 | Angulas et al. |
| 5,269,453 | A | 12/1993 | Melton et al. |
| 5,274,918 | A | 1/1994 | Reed |
| 5,275,330 | A | 1/1994 | Isaacs et al. |
| 5,276,964 | A | 1/1994 | Anderson, Jr. et al. |
| 5,277,624 | A | 1/1994 | Champion et al. |
| 5,284,287 | A | 2/1994 | Wilson et al. |
| 5,285,163 | A | 2/1994 | Liotta |
| 5,286,212 | A | 2/1994 | Broeksteeg |
| 5,288,949 | A | 2/1994 | Crafts |
| 5,295,843 | A | 3/1994 | Davis et al. |
| 5,298,791 | A | 3/1994 | Liberty et al. |
| 5,302,135 | A | 4/1994 | Lee |
| 5,321,582 | A | 6/1994 | Casperson |
| 5,324,569 | A | 6/1994 | Nagesh et al. |
| 5,342,211 | A | 8/1994 | Broeksteeg |
| 5,344,327 | A | 9/1994 | Brunker et al. |
| 5,346,118 | A | 9/1994 | Degani et al. |
| 5,354,219 | A | 10/1994 | Wanjura |
| 5,355,283 | A | 10/1994 | Marrs et al. |
| 5,356,300 | A | 10/1994 | Costello et al. |
| 5,356,301 | A | 10/1994 | Champion et al. |
| 5,357,050 | A | 10/1994 | Baran et al. |
| 5,358,417 | A | 10/1994 | Schmedding |
| 5,377,902 | A | 1/1995 | Hayes |
| 5,381,314 | A | 1/1995 | Rudy, Jr. et al. |
| 5,382,168 | A | 1/1995 | Azuma et al. |
| D355,409 | S | 2/1995 | Krokaugger |
| 5,387,111 | A | 2/1995 | DeSantis et al. |
| 5,387,139 | A | 2/1995 | McKee et al. |
| 5,395,250 | A | 3/1995 | Englert, Jr. et al. |
| 5,400,949 | A | 3/1995 | Hirvonen et al. |
| 5,403,206 | A | 4/1995 | McNamara et al. |
| 5,409,157 | A | 4/1995 | Nagesh et al. |
| 5,410,807 | A | 5/1995 | Bross et al. |
| 5,427,543 | A | 6/1995 | Dynia |
| 5,429,520 | A | 7/1995 | Morlion et al. |
| 5,429,521 | A | 7/1995 | Morlion et al. |
| 5,431,332 | A | 7/1995 | Kirby et al. |
| 5,431,578 | A | 7/1995 | Wayne |
| 5,433,617 | A | 7/1995 | Morlion et al. |
| 5,433,618 | A | 7/1995 | Morlion et al. |
| 5,435,482 | A | 7/1995 | Variot et al. |
| 5,442,852 | A | 8/1995 | Danner |
| 5,445,313 | A | 8/1995 | Boyd et al. |
| 5,457,342 | A | 10/1995 | Herbst, II |
| 5,458,426 | A | 10/1995 | Ito |
| 5,462,456 | A | 10/1995 | Howell |
| 5,467,913 | A | 11/1995 | Namekawa et al. |
| 5,474,472 | A | 12/1995 | Niwa et al. |
| 5,475,922 | A | 12/1995 | Tamura et al. |
| 5,477,933 | A | 12/1995 | Nguyen |
| 5,489,750 | A | 2/1996 | Sakemi et al. |
| 5,490,040 | A | 2/1996 | Gaudenzi et al. |
| 5,491,303 | A | 2/1996 | Weiss |
| 5,492,266 | A | 2/1996 | Hoebener et al. |
| 5,495,668 | A | 3/1996 | Furusawa et al. |
| 5,496,183 | A | 3/1996 | Soes et al. |
| 5,498,167 | A | 3/1996 | Seto et al. |
| 5,499,487 | A | 3/1996 | McGill |
| 5,504,277 | A | 4/1996 | Danner |
| 5,511,987 | A | 4/1996 | Shinchi |
| 5,512,519 | A | 4/1996 | Hwang |
| 5,516,030 | A | 5/1996 | Denton |
| 5,516,032 | A | 5/1996 | Sakemi et al. |
| 5,518,410 | A | 5/1996 | Masami |
| 5,519,580 | A | 5/1996 | Natarajan et al. |
| 5,522,727 | A | 6/1996 | Saito et al. |
| 5,533,915 | A | 7/1996 | Deans |
| 5,534,127 | A | 7/1996 | Sakai |
| 5,539,153 | A | 7/1996 | Schwiebert et al. |
| 5,542,174 | A | 8/1996 | Chiu |
| 5,558,542 | A | 9/1996 | O'Sullivan et al. |
| 5,564,952 | A | 10/1996 | Davis |
| 5,575,688 | A | 11/1996 | Crane, Jr. |
| 5,577,928 | A | 11/1996 | Duclos |
| 5,580,283 | A | 12/1996 | O'Sullivan et al. |
| 5,586,908 | A | 12/1996 | Lorrain |
| 5,586,914 | A | 12/1996 | Foster, Jr. et al. |
| 5,588,859 | A | 12/1996 | Maurice |
| 5,590,463 | A | 1/1997 | Feldman et al. |
| 5,591,118 | A | 1/1997 | Bierck |
| 5,591,941 | A | 1/1997 | Acocella et al. |

(56) References Cited

U.S. PATENT DOCUMENTS 5,593,322 A 1/1997 Swamy et al.
5,605,417 A 2/1997 Englert et al.
5,609,502 A 3/1997 Thumma
5,613,882 A 3/1997 Hnatuck et al.
5,618,187 A 4/1997 Goto
5,634,821 A 6/1997 Crane, Jr.
5,637,008 A 6/1997 Kozel
5,637,019 A 6/1997 Crane, Jr. et al.
5,643,009 A 7/1997 Dinkel et al.
5,664,968 A 9/1997 Mickievicz
5,664,973 A 9/1997 Emmert et al.
5,667,392 A 9/1997 Kocher et al.
5,672,064 A 9/1997 Provencher et al.
5,691,041 A 11/1997 Frankeny et al.
D387,733 S 12/1997 Lee
5,697,799 A 12/1997 Consoli et al.
5,702,255 A 12/1997 Murphy et al.
5,713,746 A 2/1998 Olson et al.
5,718,606 A 2/1998 Rigby et al.
5,727,963 A 3/1998 LeMaster
5,730,609 A 3/1998 Harwath
5,733,453 A 3/1998 DeBusk
5,741,144 A 4/1998 Elco et al.
5,741,161 A 4/1998 Cahaly et al.
5,742,484 A 4/1998 Gillette et al.
5,743,009 A 4/1998 Matsui et al.
5,743,765 A 4/1998 Andrews et al.
5,745,349 A 4/1998 Lemke
5,746,608 A 5/1998 Taylor
5,749,746 A 5/1998 Tan et al.
5,755,595 A 5/1998 Davis et al.
5,766,023 A 6/1998 Noschese et al.
5,772,451 A 6/1998 Dozier, II et al.
5,782,644 A 7/1998 Kiat
5,787,971 A 8/1998 Dodson
5,795,191 A 8/1998 Preputnick et al.
5,810,607 A 9/1998 Shih et al.
5,817,973 A 10/1998 Elco
5,827,094 A 10/1998 Aizawa et al.
5,831,314 A 11/1998 Wen
5,833,475 A 11/1998 Mitra
5,846,024 A 12/1998 Mao et al.
5,851,121 A 12/1998 Thenaisie et al.
5,853,797 A 12/1998 Fuchs et al.
5,857,857 A 1/1999 Fukuda
5,860,816 A 1/1999 Provencher et al.
5,871,362 A 2/1999 Campbell et al.
5,874,776 A 2/1999 Kresge et al.
5,876,219 A 3/1999 Taylor et al.
5,876,222 A 3/1999 Gardner et al.
5,876,248 A 3/1999 Brunker et al.
5,882,214 A 3/1999 Hillbish et al.
5,883,782 A 3/1999 Thurston et al.
5,887,158 A 3/1999 Sample et al.
5,888,884 A 3/1999 Wojnarowski
5,892,791 A 4/1999 Moon
5,893,761 A 4/1999 Longueville
5,902,136 A 5/1999 Lemke et al.
5,904,581 A 5/1999 Pope et al.
5,908,333 A 6/1999 Perino et al.
5,913,702 A 6/1999 Garcin
5,919,050 A 7/1999 Kehley et al.
5,930,114 A 7/1999 Kuzmin et al.
5,938,479 A 8/1999 Paulson et al.
5,943,770 A 8/1999 Thenaisie et al.
5,955,888 A 9/1999 Frederickson et al.
5,961,355 A 10/1999 Morlion et al.
5,967,844 A 10/1999 Doutrich et al.
5,971,817 A 10/1999 Longueville
5,975,921 A 11/1999 Shuey
5,980,270 A 11/1999 Fjelstad et al.
5,980,321 A 11/1999 Cohen et al.
5,982,249 A 11/1999 Bruns
5,984,690 A 11/1999 Riechelmann et al.
5,984,726 A 11/1999 Wu
5,992,953 A 11/1999 Rabinovitz
5,993,259 A 11/1999 Stokoe et al.
6,012,948 A 1/2000 Wu
6,022,227 A 2/2000 Huang
6,024,584 A 2/2000 Lemke et al.
6,027,381 A 2/2000 Lok
6,036,549 A 3/2000 Wulff
6,041,498 A 3/2000 Hillbish et al.
6,042,389 A 3/2000 Lemke et al.
6,042,394 A 3/2000 Mitra et al.
6,042,427 A 3/2000 Adriaenssens et al.
6,050,842 A 4/2000 Ferrill et al.
6,050,862 A 4/2000 Ishii
6,053,751 A 4/2000 Humphrey
6,059,170 A 5/2000 Jimarez et al.
6,066,048 A 5/2000 Lees
6,068,520 A 5/2000 Winings et al.
6,071,152 A 6/2000 Achammer et al.
6,077,130 A 6/2000 Hughes et al.
6,083,047 A 7/2000 Paagman
6,086,386 A 7/2000 Fjelstad et al.
6,089,878 A 7/2000 Meng
6,095,827 A 8/2000 Dutkowsky et al.
6,113,418 A 9/2000 Kjeldahl
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,152,756 A 11/2000 Huang et al.
6,154,742 A 11/2000 Herriot
6,171,115 B1 1/2001 Mickievicz et al.
6,171,149 B1 1/2001 van Zanten
6,174,198 B1 1/2001 Wu et al.
6,179,663 B1 1/2001 Bradley et al.
6,180,891 B1 1/2001 Murdeshwar
6,183,287 B1 2/2001 Po
6,183,301 B1 2/2001 Paagman
6,190,213 B1 2/2001 Reichart et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,206,735 B1 3/2001 Zanolli
6,210,197 B1 4/2001 Yu
6,210,240 B1 4/2001 Comerci et al.
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncini et al.
6,227,882 B1 5/2001 Ortega et al.
6,231,391 B1 * 5/2001 Ramey ..... H01R 12/585
439/607.07
6,234,851 B1 5/2001 Phillips
6,238,225 B1 5/2001 Middlehurst et al.
6,241,535 B1 6/2001 Lemke et al.
6,244,887 B1 6/2001 Commerci et al.
6,257,478 B1 7/2001 Straub
6,259,039 B1 7/2001 Chroneos, Jr. et al.
6,261,132 B1 7/2001 Koseki et al.
6,267,604 B1 7/2001 Mickievicz et al.
6,269,539 B1 8/2001 Takahashi et al.
6,274,474 B1 8/2001 Caletka et al.
6,280,209 B1 8/2001 Bassler et al.
6,280,230 B1 8/2001 Takase et al.
6,280,809 B1 8/2001 Wang et al.
6,290,552 B1 9/2001 Saito et al.
6,293,827 B1 9/2001 Stokoe
6,299,483 B1 10/2001 Cohen et al.
6,299,484 B2 10/2001 Van Woensel
6,299,492 B1 10/2001 Pierini et al.

(56) References Cited

U.S. PATENT DOCUMENTS 6,302,711 B1 10/2001 Ito
6,309,245 B1 10/2001 Sweeney
6,319,075 B1 11/2001 Clark et al.
6,322,377 B2 11/2001 Middlehurst et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 * 2/2002 Billman ..... H01R 13/2414 439/101
6,347,952 B1 2/2002 Hasegawa et al.
6,347,962 B1 2/2002 Kline
6,350,134 B1 2/2002 Fogg et al.
6,354,877 B1 3/2002 Shuey et al.
6,358,061 B1 3/2002 Regnier
6,359,783 B1 3/2002 Noble
6,360,940 B1 3/2002 Bolde et al.
6,361,366 B1 3/2002 Shuey et al.
6,361,376 B1 3/2002 Onoda
6,362,961 B1 3/2002 Chiou
6,363,607 B1 4/2002 Chen et al.
6,364,710 B1 4/2002 Billman et al.
6,371,773 B1 4/2002 Crofoot et al.
6,371,813 B2 4/2002 Ramey et al.
6,375,478 B1 4/2002 Kikuchi
6,375,508 B1 4/2002 Pickles et al.
6,379,188 B1 4/2002 Cohen et al.
6,386,914 B1 5/2002 Collins et al.
6,386,924 B2 5/2002 Long
6,390,826 B1 5/2002 Affolter et al.
6,394,818 B1 5/2002 Smalley, Jr.
6,402,566 B1 6/2002 Middlehurst et al.
6,409,543 B1 6/2002 Astbury, Jr. et al.
6,414,248 B1 7/2002 Sundstrom
6,420,778 B1 7/2002 Sinyansky
6,425,785 B1 7/2002 Azuma
6,428,328 B2 8/2002 Haba et al.
6,431,914 B1 8/2002 Billman
6,431,921 B2 8/2002 Saito et al.
6,435,914 B1 8/2002 Billman
6,450,829 B1 9/2002 Weisz-Margulescu
6,457,983 B1 10/2002 Bassler et al.
6,461,183 B1 10/2002 Ohkita et al.
6,461,202 B2 10/2002 Kline
6,464,529 B1 10/2002 Jensen et al.
6,471,523 B1 10/2002 Shuey
6,471,548 B2 10/2002 Bertoncini et al.
6,472,474 B2 10/2002 Burkhardt et al.
6,482,038 B2 11/2002 Olson
6,485,330 B1 11/2002 Doutrich
6,488,549 B1 12/2002 Weller et al.
6,489,567 B2 12/2002 Zachrai
6,491,545 B1 12/2002 Spiegel et al.
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,517,360 B1 2/2003 Cohen
6,520,803 B1 2/2003 Dunn
6,526,519 B1 2/2003 Cuthbert
6,527,587 B1 3/2003 Ortega et al.
6,527,588 B2 3/2003 Paagman
6,528,737 B1 3/2003 Kwong et al.
6,530,134 B1 3/2003 Laphan et al.
6,537,086 B1 3/2003 MacMullin
6,537,111 B2 3/2003 Brammer et al.
6,540,522 B2 4/2003 Sipe
6,540,558 B1 4/2003 Paagman
6,540,559 B1 4/2003 Kemmick et al.
6,544,046 B1 4/2003 Hahn et al.
6,544,072 B2 4/2003 Olson
6,547,066 B2 4/2003 Koch
6,551,112 B1 4/2003 Li et al.
6,551,140 B2 * 4/2003 Billman ..... H01R 13/514 439/607.07
6,554,647 B1 4/2003 Cohen et al.
6,565,387 B2 5/2003 Cohen
6,565,388 B1 5/2003 Van Woensel et al.
6,572,409 B2 6/2003 Nitta et al.
6,572,410 B1 6/2003 Volstorf et al.
6,575,774 B2 6/2003 Ling et al.
6,575,776 B1 6/2003 Conner et al.
6,589,071 B1 7/2003 Lias et al.
6,592,381 B2 7/2003 Cohen et al.
6,602,095 B2 8/2003 Astbury, Jr. et al.
6,604,967 B2 8/2003 Middlehurst et al.
6,607,402 B2 8/2003 Cohen et al.
6,623,310 B1 9/2003 Billman et al.
6,629,854 B2 10/2003 Murakami
6,633,490 B2 10/2003 Centola et al.
6,641,410 B2 11/2003 Marvin et al.
6,641,411 B1 11/2003 Stoddard et al.
6,641,825 B2 11/2003 Scholz et al.
6,652,318 B1 11/2003 Winings et al.
6,663,426 B2 12/2003 Hasircoglu et al.
6,665,189 B1 12/2003 Lebo
6,666,693 B2 12/2003 Belopolsky et al.
6,669,514 B2 12/2003 Wiebking et al.
6,672,884 B1 1/2004 Toh et al.
6,672,907 B2 1/2004 Azuma
6,679,709 B2 1/2004 Takeuchi
6,692,272 B2 2/2004 Lemke et al.
6,695,627 B2 2/2004 Ortega et al.
6,702,590 B2 3/2004 Zaderej et al.
6,702,594 B2 3/2004 Lee et al.
6,705,902 B1 3/2004 Yi et al.
6,709,294 B1 3/2004 Cohen et al.
6,712,621 B2 3/2004 Li et al.
6,712,646 B2 3/2004 Shindo
6,716,045 B2 4/2004 Meredith
6,716,068 B2 4/2004 Wu
6,717,825 B2 4/2004 Volstorf
6,726,492 B1 4/2004 Yu
6,736,664 B2 5/2004 Ueda et al.
6,739,910 B1 5/2004 Wu
6,740,820 B2 5/2004 Cheng
D492,295 S 6/2004 Glatt
6,743,037 B2 6/2004 Kassa et al.
6,743,059 B1 6/2004 Korsunsky et al.
6,746,278 B2 6/2004 Nelson et al.
6,749,439 B1 6/2004 Potter et al.
6,762,067 B1 7/2004 Quinones et al.
6,764,341 B2 7/2004 Lappoehn
6,769,883 B2 8/2004 Brid et al.
6,769,935 B2 8/2004 Stokoe et al.
6,776,635 B2 8/2004 Blanchfield et al.
6,776,649 B2 8/2004 Pape et al.
6,780,027 B2 8/2004 Allison
6,786,771 B2 9/2004 Gailus
6,790,088 B2 9/2004 Ono et al.
6,796,831 B1 9/2004 Yasufuku et al.
6,797,215 B2 9/2004 Bonk et al.
6,799,215 B1 9/2004 Giroir et al.
D497,343 S 10/2004 Busse et al.
6,805,278 B1 10/2004 Olson et al.
6,808,399 B2 10/2004 Rothermel et al.
6,808,420 B2 10/2004 Whiteman, Jr. et al.
6,810,783 B1 11/2004 Larose
6,811,440 B1 11/2004 Rothermel et al.
6,814,590 B2 11/2004 Minich et al.
6,814,619 B1 11/2004 Stokoe et al.
6,824,391 B2 11/2004 Mickievicz et al.
6,829,143 B2 12/2004 Russell et al.
6,835,072 B2 12/2004 Simons et al.
6,835,103 B2 12/2004 Middlehurst et al.
6,843,686 B2 1/2005 Ohnishi et al.
6,843,687 B2 1/2005 McGowan et al.
6,848,886 B2 2/2005 Schmaling et al.
6,848,944 B2 2/2005 Evans
6,848,950 B2 2/2005 Allison et al.
6,848,953 B2 2/2005 Schell et al.
6,851,974 B2 2/2005 Doutrich
6,851,980 B2 2/2005 Nelson et al.
6,852,567 B1 2/2005 Lee et al.

(56) References Cited

U.S. PATENT DOCUMENTS

| | | | |
|---|---|---|---|
| D502,919 | S | 3/2005 | Studnicky, III |
| 6,866,549 | B2 | 3/2005 | Kimura et al. |
| 6,869,292 | B2 | 3/2005 | Johnescu et al. |
| 6,872,085 | B1 | 3/2005 | Cohen et al. |
| 6,884,117 | B2 | 4/2005 | Korsunsky et al. |
| 6,890,214 | B2 | 5/2005 | Brown et al. |
| 6,890,221 | B2 | 5/2005 | Wagner |
| 6,893,272 | B2 | 5/2005 | Yu |
| 6,893,300 | B2 | 5/2005 | Zhou et al. |
| 6,893,686 | B2 | 5/2005 | Egan |
| 6,899,566 | B2 | 5/2005 | Kline et al. |
| 6,902,411 | B2 | 6/2005 | Kubo |
| 6,905,367 | B2 | 6/2005 | Crane, Jr. et al. |
| 6,913,490 | B2 | 7/2005 | Whiteman, Jr. et al. |
| 6,918,776 | B2 | 7/2005 | Spink, Jr. |
| 6,918,789 | B2 | 7/2005 | Lang et al. |
| 6,929,504 | B2 | 8/2005 | Ling et al. |
| 6,932,649 | B1 | 8/2005 | Rothermel et al. |
| 6,939,173 | B1 | 9/2005 | Elco et al. |
| 6,945,796 | B2 | 9/2005 | Bassler et al. |
| 6,947,012 | B2 | 9/2005 | Aisenbrey |
| 6,951,466 | B2 | 10/2005 | Sandoval et al. |
| 6,953,351 | B2 | 10/2005 | Fromm et al. |
| 6,969,268 | B2 | 11/2005 | Brunker et al. |
| 6,969,280 | B2 | 11/2005 | Chien et al. |
| 6,975,511 | B1 | 12/2005 | Lebo et al. |
| 6,976,886 | B2 | 12/2005 | Winings et al. |
| 6,979,202 | B2 | 12/2005 | Benham et al. |
| 6,979,215 | B2 | 12/2005 | Avery et al. |
| 6,981,883 | B2 | 1/2006 | Raistrick et al. |
| 6,988,902 | B2 | 1/2006 | Winings et al. |
| 6,994,569 | B2 | 2/2006 | Minich et al. |
| 7,001,189 | B1 | 2/2006 | McGowan et al. |
| 7,021,975 | B2 | 4/2006 | Lappohn |
| 7,040,901 | B2 | 5/2006 | Benham et al. |
| 7,044,794 | B2 | 5/2006 | Consoli et al. |
| 7,059,892 | B1 | 6/2006 | Trout |
| 7,059,919 | B2 | 6/2006 | Clark et al. |
| 7,065,871 | B2 | 6/2006 | Minich et al. |
| 7,070,464 | B2 | 7/2006 | Clark et al. |
| 7,074,096 | B2 | 7/2006 | Copper et al. |
| 7,086,147 | B2 | 8/2006 | Caletka et al. |
| 7,090,501 | B1 | 8/2006 | Scherer et al. |
| 7,094,102 | B2 | 8/2006 | Cohen et al. |
| 7,097,465 | B1 | 8/2006 | Korsunsky et al. |
| 7,097,506 | B2 | 8/2006 | Nakada |
| 7,101,191 | B2 | 9/2006 | Benham et al. |
| 7,101,228 | B2 | 9/2006 | Hamner et al. |
| 7,104,812 | B1 | 9/2006 | Bogiel et al. |
| 7,108,556 | B2 | 9/2006 | Cohen et al. |
| 7,114,963 | B2 | 10/2006 | Shuey et al. |
| 7,114,964 | B2 | 10/2006 | Winings et al. |
| 7,118,391 | B2 | 10/2006 | Minich et al. |
| RE39,380 | E | 11/2006 | Davis |
| 7,131,870 | B2 | 11/2006 | Whiteman, Jr. et al. |
| 7,137,848 | B1 | 11/2006 | Trout et al. |
| 7,153,162 | B2 | 12/2006 | Mizumura et al. |
| 7,160,151 | B1 | 1/2007 | Rigby et al. |
| 7,163,421 | B1 | 1/2007 | Cohen et al. |
| 7,168,963 | B2 | 1/2007 | Minich et al. |
| 7,172,461 | B2 | 2/2007 | Davis et al. |
| 7,182,642 | B2 | 2/2007 | Ngo et al. |
| 7,182,643 | B2 | 2/2007 | Winings et al. |
| D540,258 | S | 4/2007 | Peng et al. |
| 7,204,699 | B2 | 4/2007 | Stoner et al. |
| 7,207,807 | B2 | 4/2007 | Fogg |
| D541,748 | S | 5/2007 | Peng et al. |
| D542,736 | S | 5/2007 | Riku |
| 7,220,141 | B2 | 5/2007 | Daily et al. |
| 7,239,526 | B1 | 7/2007 | Bibee |
| 7,241,168 | B2 | 7/2007 | Sakurai et al. |
| 7,258,562 | B2 | 8/2007 | Daily et al. |
| D550,158 | S | 9/2007 | Victor |
| D550,628 | S | 9/2007 | Whiteman, Jr. et al. |
| 7,267,515 | B2 | 9/2007 | Lappohn |
| 7,270,574 | B1 | 9/2007 | Ngo |
| 7,273,382 | B2 | 9/2007 | Igarashi et al. |
| 7,278,856 | B2 | 10/2007 | Minich |
| 7,281,950 | B2 | 10/2007 | Belopolsky |
| D554,591 | S | 11/2007 | Victor |
| 7,292,055 | B2 | 11/2007 | Egitto et al. |
| 7,303,427 | B2 | 12/2007 | Swain |
| 7,309,239 | B2 | 12/2007 | Shuey et al. |
| 7,316,585 | B2 | 1/2008 | Smith et al. |
| 7,322,855 | B2 | 1/2008 | Mongold et al. |
| 7,331,802 | B2 | 2/2008 | Rothermel et al. |
| 7,335,043 | B2 | 2/2008 | Ngo et al. |
| 7,338,321 | B2 | 3/2008 | Laurx |
| 7,347,740 | B2 | 3/2008 | Minich |
| 7,351,071 | B2 | 4/2008 | Korsunsky et al. |
| 7,381,092 | B2 | 6/2008 | Nakada |
| 7,384,289 | B2 | 6/2008 | Minich |
| 7,384,311 | B2 | 6/2008 | Sharf et al. |
| 7,402,064 | B2 | 7/2008 | Daily et al. |
| 7,407,387 | B2 | 8/2008 | Johnescu et al. |
| 7,422,483 | B2 | 9/2008 | Avery et al. |
| 7,425,145 | B2 | 9/2008 | Ngo |
| 7,429,176 | B2 | 9/2008 | Johnescu et al. |
| 7,445,457 | B1 | 11/2008 | Frangioso, Jr. et al. |
| 7,452,242 | B2 | 11/2008 | Poh et al. |
| 7,452,249 | B2 | 11/2008 | Daily et al. |
| 7,458,839 | B2 | 12/2008 | Ngo et al. |
| 7,467,955 | B2 | 12/2008 | Raistrick et al. |
| 7,476,108 | B2 | 1/2009 | Swain et al. |
| 7,497,735 | B2 | 3/2009 | Belopolsky |
| 7,497,736 | B2 | 3/2009 | Minich et al. |
| 7,500,871 | B2 | 3/2009 | Minich et al. |
| 7,503,804 | B2 | 3/2009 | Minich |
| 7,541,135 | B2 | 6/2009 | Swain |
| 7,549,897 | B2 | 6/2009 | Fedder et al. |
| 7,553,182 | B2 | 6/2009 | Buck et al. |
| 7,588,463 | B2 | 9/2009 | Yamada et al. |
| 7,621,781 | B2 | 11/2009 | Rothermel et al. |
| D607,822 | S | 1/2010 | Dennes |
| D611,908 | S | 3/2010 | Takada et al. |
| 7,708,569 | B2 | 5/2010 | Sercu et al. |
| D618,180 | S | 6/2010 | Gross et al. |
| D618,181 | S | 6/2010 | Gross et al. |
| 7,753,731 | B2 | 7/2010 | Cohen et al. |
| 7,762,843 | B2 | 7/2010 | Minich et al. |
| D626,075 | S | 10/2010 | Truskett et al. |
| 7,833,065 | B2 | 11/2010 | Lin et al. |
| D628,963 | S | 12/2010 | Sau et al. |
| 7,883,366 | B2 | 2/2011 | Davis et al. |
| 7,976,326 | B2 | 7/2011 | Stoner |
| 7,988,456 | B2 | 8/2011 | Davis et al. |
| 8,011,957 | B2 | 9/2011 | Pan |
| D651,177 | S | 12/2011 | Luo |
| 8,079,847 | B2 | 12/2011 | Davis et al. |
| D653,621 | S | 2/2012 | Gross et al. |
| 8,109,770 | B2 | 2/2012 | Perugini et al. |
| 8,119,926 | B2 | 2/2012 | Murphy |
| 8,157,599 | B2 | 4/2012 | Wei |
| 8,231,415 | B2 | 7/2012 | Johnescu et al. |
| 8,277,241 | B2 | 10/2012 | Horchler et al. |
| 8,366,485 | B2 | 2/2013 | Johnescu et al. |
| 8,408,939 | B2 | 4/2013 | Davis et al. |
| 8,414,199 | B2 | 4/2013 | Ishigami |
| 8,465,213 | B2 | 6/2013 | Tamura et al. |
| 8,480,413 | B2 | 7/2013 | Minich et al. |
| RE44,556 | E | 10/2013 | Minich et al. |
| D712,843 | S | 9/2014 | Buck et al. |
| D718,253 | S | 11/2014 | Zerebilov et al. |
| D720,698 | S | 1/2015 | Zerebilov et al. |
| D727,268 | S | 4/2015 | Buck et al. |
| D727,852 | S | 4/2015 | Buck et al. |
| 9,048,583 | B2 | 6/2015 | Johnescu et al. |
| D745,852 | S | 12/2015 | Harper et al. |
| D751,507 | S | 3/2016 | Horchler |
| 9,461,410 | B2 | 10/2016 | Johnescu et al. |
| 2001/0003685 | A1 | 6/2001 | Aritani |
| 2001/0008189 | A1 | 7/2001 | Reede |
| 2001/0012729 | A1 | 8/2001 | Van Woensel |
| 2001/0041477 | A1 | 11/2001 | Billman et al. |

(56) References Cited

U.S. PATENT DOCUMENTS

2001/0046810 A1 11/2001 Cohen et al.
2001/0046816 A1 11/2001 Saito et al.
2002/0013101 A1 1/2002 Long
2002/0039857 A1 4/2002 Naito et al.
2002/0084105 A1 7/2002 Geng et al.
2002/0098727 A1 7/2002 McNamara et al.
2002/0106930 A1 8/2002 Pape et al.
2002/0106932 A1 8/2002 Holland et al.
2002/0111068 A1 8/2002 Cohen et al.
2002/0127903 A1 9/2002 Billman et al.
2002/0142629 A1 10/2002 Zaderej et al.
2002/0142676 A1 10/2002 Hosaka et al.
2002/0159235 A1 10/2002 Miller et al.
2002/0173177 A1 11/2002 Korsunsky et al.
2002/0187688 A1 12/2002 Marvin et al.
2002/0193019 A1 12/2002 Blanchfield et al.
2003/0116857 A1 6/2003 Taniguchi et al.
2003/0119378 A1 6/2003 Avery
2003/0143894 A1 7/2003 Kline et al.
2003/0171010 A1 9/2003 Winings et al.
2003/0203665 A1 10/2003 Ohnishi et al.
2003/0219999 A1 11/2003 Minich et al.
2003/0220021 A1 11/2003 Whiteman et al.
2003/0236035 A1 12/2003 Kuroda et al.
2004/0018757 A1 1/2004 Lang et al.
2004/0038590 A1 2/2004 Lang et al.
2004/0072470 A1 4/2004 Lang et al.
2004/0077224 A1 4/2004 Marchese
2004/0087196 A1 5/2004 Lang et al.
2004/0114866 A1 6/2004 Hiramatsu
2004/0157477 A1 8/2004 Johnson et al.
2004/0224559 A1 11/2004 Nelson et al.
2004/0235321 A1 11/2004 Mizumura et al.
2004/0259420 A1 12/2004 Wu
2005/0009402 A1 1/2005 Chien et al.
2005/0026503 A1 2/2005 Trout et al.
2005/0032401 A1 2/2005 Kobayashi
2005/0048838 A1 3/2005 Korsunsky et al.
2005/0079763 A1 4/2005 Lemke et al.
2005/0101166 A1 5/2005 Kameyama
2005/0101188 A1 5/2005 Benham et al.
2005/0112952 A1 5/2005 Wang et al.
2005/0118869 A1 6/2005 Evans
2005/0170700 A1 8/2005 Shuey et al.
2005/0196987 A1 9/2005 Shuey et al.
2005/0202722 A1 9/2005 Regnier et al.
2005/0215121 A1 9/2005 Tokunaga
2005/0227552 A1 10/2005 Yamashita et al.
2005/0277315 A1 12/2005 Mongold et al.
2005/0287869 A1 12/2005 Kenny et al.
2006/0003620 A1 1/2006 Daily et al.
2006/0014433 A1 1/2006 Consoli et al.
2006/0024983 A1 2/2006 Cohen et al.
2006/0024984 A1 2/2006 Cohen et al.
2006/0046526 A1 3/2006 Minich
2006/0051987 A1 3/2006 Goodman et al.
2006/0068610 A1 3/2006 Belopolsky
2006/0068641 A1 3/2006 Hull et al.
2006/0073709 A1 4/2006 Reid
2006/0116857 A1 6/2006 Sevic et al.
2006/0121749 A1 6/2006 Fogg
2006/0128197 A1 6/2006 McGowan et al.
2006/0141818 A1 6/2006 Ngo
2006/0183377 A1 8/2006 Sinsheimer
2006/0192274 A1 8/2006 Lee et al.
2006/0216969 A1 9/2006 Bright et al.
2006/0228912 A1 10/2006 Morlion et al.
2006/0232301 A1 10/2006 Morlion et al.
2006/0281354 A1 12/2006 Ngo et al.
2007/0004287 A1 1/2007 Marshall
2007/0021002 A1 1/2007 Laurx et al.
2007/0042639 A1 2/2007 Manter et al.
2007/0071391 A1 3/2007 Mazotti et al.
2007/0099455 A1 5/2007 Rothermel et al.
2007/0099512 A1 5/2007 Sato
2007/0183707 A1 8/2007 Umezawa
2007/0183724 A1 8/2007 Sato
2007/0202715 A1 8/2007 Daily et al.
2007/0202747 A1 8/2007 Sharf et al.
2007/0205774 A1 9/2007 Minich
2007/0207641 A1 9/2007 Minich
2007/0293084 A1 12/2007 Ngo
2008/0032524 A1 2/2008 Lemke et al.
2008/0045079 A1 2/2008 Minich et al.
2008/0176453 A1 7/2008 Minich et al.
2008/0232737 A1 9/2008 Ishigami et al.
2008/0246555 A1 10/2008 Kirk et al.
2008/0248670 A1 10/2008 Daily et al.
2008/0316729 A1 12/2008 Rothermel et al.
2009/0011643 A1 1/2009 Amleshi et al.
2010/0055983 A1 3/2010 Wu
2010/0093209 A1 4/2010 Liu et al.
2010/0216342 A1 8/2010 Lin
2010/0240233 A1 9/2010 Johnescu et al.
2010/0291803 A1 11/2010 Kirk
2011/0097934 A1 4/2011 Minich
2011/0159744 A1 6/2011 Buck
2011/0195593 A1 8/2011 McGrath et al.
2012/0202363 A1 8/2012 McNamara et al.
2012/0214343 A1 8/2012 Buck et al.
2012/0289095 A1 11/2012 Kirk
2013/0005160 A1 1/2013 Minich
2013/0090025 A1 4/2013 Trout et al.
2013/0122744 A1 5/2013 Morgan et al.
2013/0149881 A1 6/2013 Johnescu et al.
2013/0149890 A1 6/2013 Schroll et al.
2013/0195408 A1 8/2013 Hermeline et al.
2013/0210246 A1 8/2013 Davis et al.
2013/0273756 A1 10/2013 Stoner et al.
2013/0273781 A1 10/2013 Buck et al.
2014/0017957 A1 1/2014 Horchler et al.
2014/0227911 A1 8/2014 Lim et al.
2014/0335707 A1 11/2014 Johnescu et al.

OTHER PUBLICATIONS

International Application No. PCT/US2010/040899, International Search Report and Written Opinion dated Jan. 25, 2011.
International Patent Application No. PCT/US2013/035775: International Search Report and Written Opinion dated Jul. 18, 2013.
International Patent Application No. PCT/US2013/035915: International Search Report and Written Opinion dated Jul. 25, 2013.
International Patent Application No. PCT/US2013/049995: International Search Report dated Oct. 28, 2013.
International Patent Application No. PCT/US2010/027399: International Search Report and Written Opinion dated Nov. 1, 2010.
"AMP Z-Pack 2mm HM Interconnection System", 1992/1994, AMP Incorporated, 6 pages.

* cited by examiner

ELECTRICAL CONNECTOR HAVING RIBBED GROUND PLATE

RELATED APPLICATIONS

This Application claims the benefit under 35 U.S.C. § 120 of U.S. application Ser. No. 14/339,769, entitled "ELECTRICAL CONNECTOR HAVING RIBBED GROUND PLATE" filed on Jul. 24, 2014, which is herein incorporated by reference in its entirety. Application Ser. No. 14/339,769 claims the benefit under 35 U.S.C. § 120 of U.S. application Ser. No. 13/755,628, entitled "ELECTRICAL CONNECTOR HAVING RIBBED GROUND PLATE" filed on Jan. 31, 2013, which is herein incorporated by reference in its entirety. Application Ser. No. 13/755,628 claims the benefit under 35 U.S.C. § 120 of U.S. application Ser. No. 12/722,797, entitled "ELECTRICAL CONNECTOR HAVING RIBBED GROUND PLATE" filed on Mar. 12, 2010, which is herein incorporated by reference in its entirety. Application Ser. No. 12/722,797 claims priority under 35 U.S.C. § 119(e) to U.S. Provisional Application Ser. No. 61/161,687, entitled "HIGH SPEED, LOW-CROSS-TALK ELECTRICAL CONNECTOR" filed on Mar. 19, 2009, which is herein incorporated by reference in its entirety.

BACKGROUND

Electrical connectors provide signal connections between electronic devices using electrically-conductive contacts. It is sometimes desirable to increase data transfer through an existing connector without changing the physical dimensions (height, width, depth, mating interface, and mounting interface) of the connector. However, it is difficult to change one aspect of an electrical connector without unintentionally changing another aspect. For example, metallic crosstalk shields can be added to an electrical connector to reduce crosstalk, but the addition of shields generally lowers the impedance. At lower data transmission speeds, such at 1 to 1.25 Gigabits/sec, impedance matching does not substantially affect performance. However, as data transmission speeds increase to 10 Gigabits/sec through 40 Gigabits/sec and any discrete point there between, skew and impedance mismatches become problematic. Therefore, while crosstalk can be lowered by adding a metallic crosstalk shield to an existing electrical connector, other problems with signal integrity can be created.

What is therefore desired is an electrical connector having a shield that avoids the shortcomings of conventional shields.

BRIEF SUMMARY

In accordance with one aspect, an electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The ground plate includes a ground plate body oriented in a second plane that is substantially parallel to the first plane and offset from the first plane. The ground plate body defines first and second opposed surfaces. The ground plate includes at least one stamped or embossed rib that defines first and second opposed surfaces, wherein the first surface of the rib projects from the first surface of the ground plate body in a direction toward the gap, and the second surface is recessed into the second surface of the ground plate body.

The foregoing is a non-limiting summary, as the invention is defined only by the appended claims.

BRIEF DESCRIPTION OF DRAWINGS

The foregoing summary, as well as the following detailed description of a preferred embodiment of the application, will be better understood when read in conjunction with the appended drawings. For the purposes of illustrating the electrical connector of the present application, there is shown in the drawings a preferred embodiment. It should be understood, however, that the application is not limited to the precise arrangements and instrumentalities shown. In the drawings.

DETAILED DESCRIPTION

Figure 1:
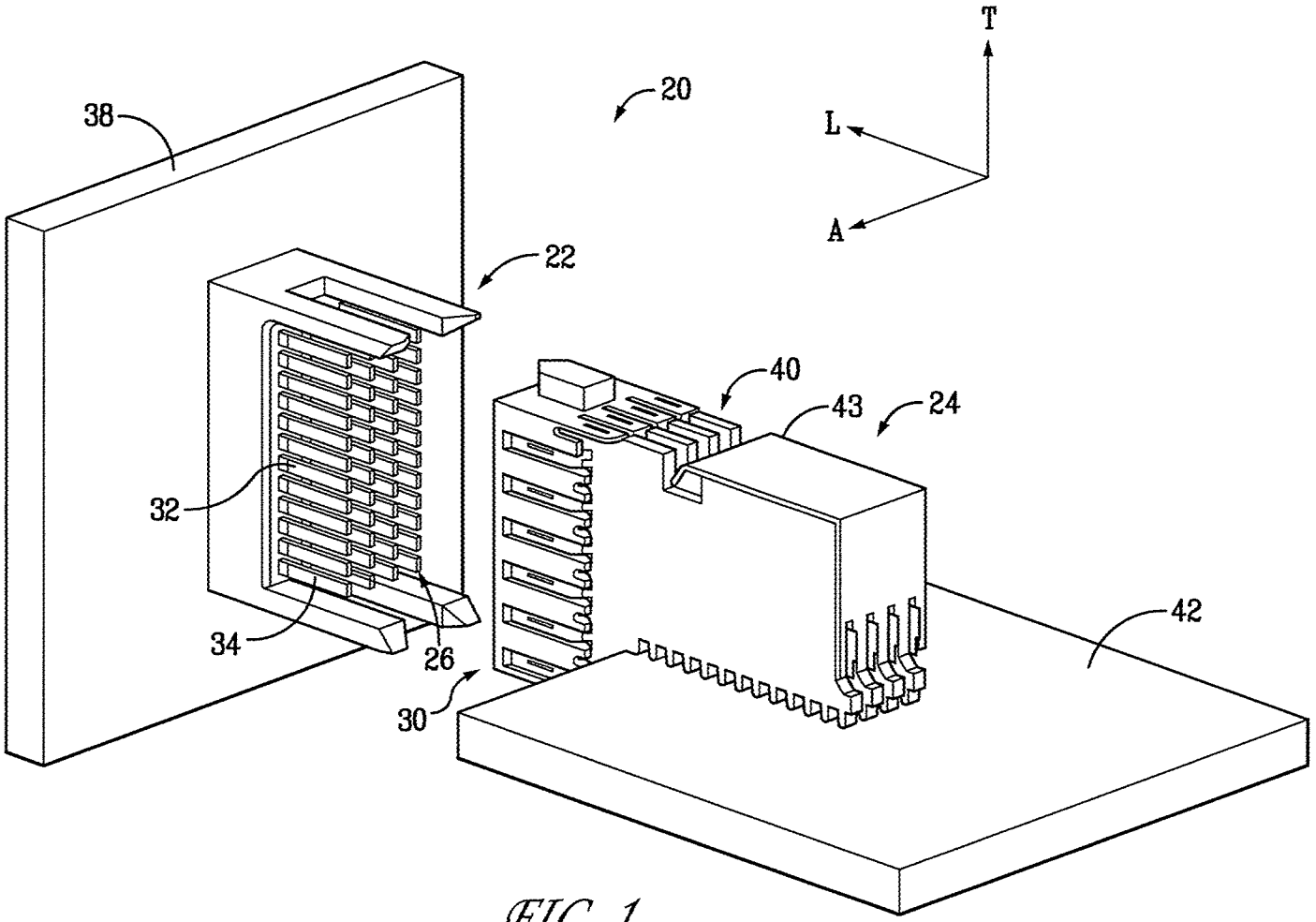
FIG. 1 is a perspective view of an electrical connector assembly including a vertical header connector and a right-angle receptacle connector mounted onto respective substrates, and configured to be mated with each other.
Figure 2A:
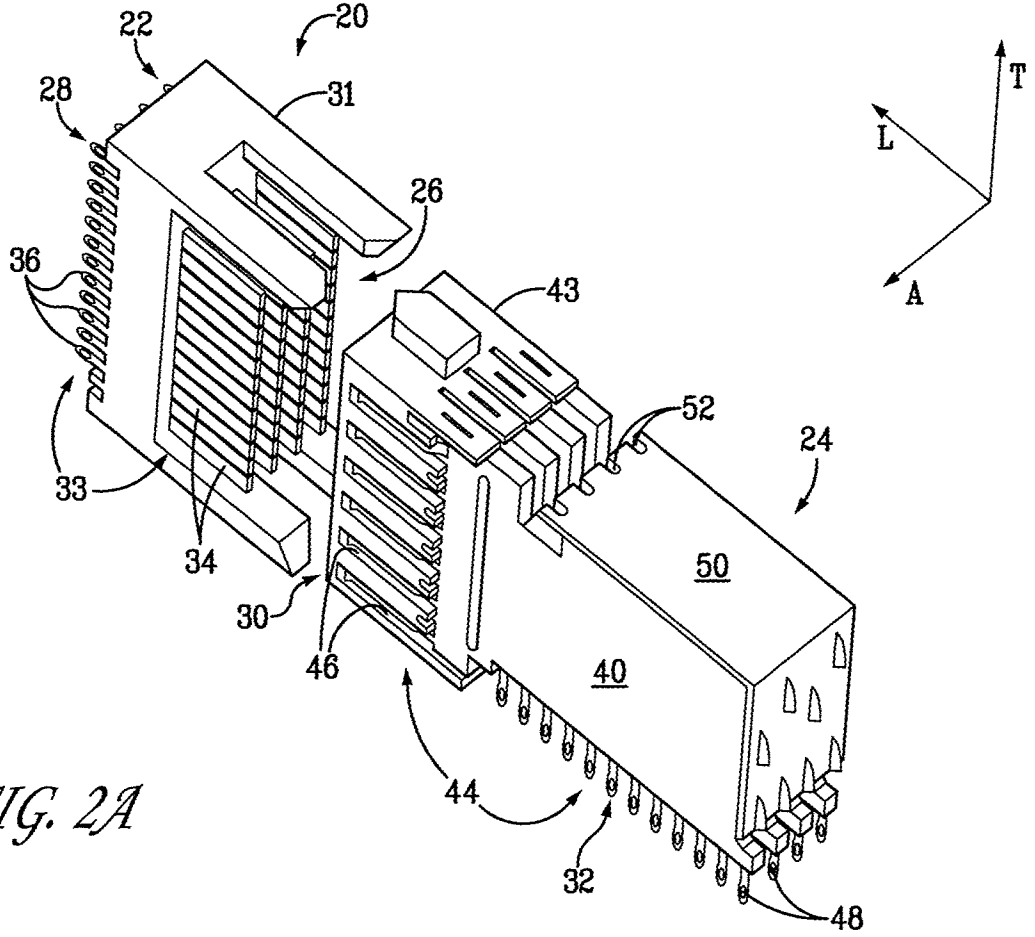
FIG. 2A is a perspective view of the electrical connector assembly similar to FIG. 1, but without the substrates.
Figure 2B:
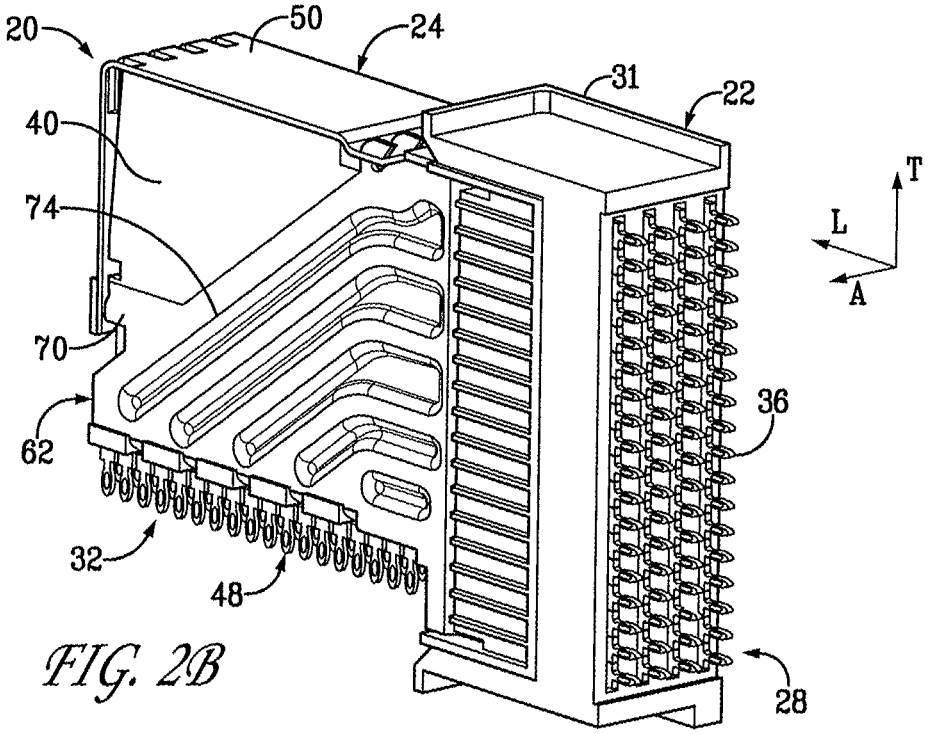
FIG. 2B is another perspective view of the electrical connector assembly as illustrated in FIG. 2A, but showing the electrical connectors in a mated configuration.

Referring initially to FIGS. 1-2B, an electrical connector assembly 20 includes a first electrical connector 22 and a second electrical connector 24 configured to mate with each other so as to establish an electrical connection between complementary substrates 38 and 42. As shown, the first electrical connector 22 can be a vertical connector defining a mating interface 26 and a mounting interface 28 that extends substantially parallel to the mating interface 26. The second electrical connector 24 can be a right-angle connector defining a mating interface 30 and a mounting interface 32 that extends substantially perpendicular to the mating interface 30.

The first electrical connector 22 includes a housing 31 that carries a plurality of electrical contacts 33. The electrical contacts 33 may be insert molded prior to attachment to the housing 31 or stitched into the housing 31. The electrical contacts 33 define respective mating ends 34 that extend along the mating interface 26, and mounting ends 36 that extend along the mounting interface 28. Each of the mating ends 34 can define a respective first broadside and a respective second broadside opposite the first broadside so as to define header mating ends. Thus, the first electrical connector 22 can be referred to as a header connector as illustrated. The mounting ends 36 may be press-fit tails, surface mount tails, or fusible elements such as solder balls, which are configured to electrically connect to a complementary electrical component such as a substrate 38 which is illustrated as a printed circuit board. The substrate 38 can be provided as a backplane, midplane, daughtercard, or the like.

Because the mating interface 26 is substantially parallel to the mounting interface 28, the first electrical connector 22 can be provided as a vertical connector, though it should be appreciated that the first electrical connector can be provided in any desired configuration so as to electrically connect the substrate 38 to the second electrical connector 24. For instance, the first electrical connector 22 can be provided as a header connector or a receptacle connector, and can be arranged as a vertical or mezzanine connector or a right-angle connector as desired.

With continuing reference to FIGS. 1-2B, the second electrical connector 24 includes a plurality of insert molded leadframe assemblies (IMLAs) 40 that are carried by an electrical connector housing 43. Each IMLA 40 carries a plurality of electrical contacts, such as right angle electrical contacts 44. Any suitable dielectric material, such as air or plastic, may be used to isolate the right angle electrical contacts 44 from one another. The right angle electrical contacts 44 define a respective receptacle mating ends 46 that extend along the mating interface 30, and a mounting ends 48 that extend along the mounting interface 32. Each mating end 46 extends horizontally forward along a longitudinal or first direction L, and the IMLAs 40 are arranged adjacent each other along a lateral or second direction A that is substantially perpendicular to the longitudinal direction L.

Each mounting end 48 extends vertically down along a transverse or third direction T that is perpendicular to both the lateral direction A and the longitudinal direction L. Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" as used to describe the orthogonal directional components of various components and do not limit to specific differential signal pair configurations. The terms "inboard" and "inner," and "outboard" and "outer" with respect to a specified directional component are used herein with respect to a given apparatus to refer to directions along the directional component toward and away from the center apparatus, respectively.

The receptacle mounting ends 48 may be constructed similar to the header mounting ends 36, and thus may include press-fit tails, surface mount tails, or fusible elements such as solder balls, which are configured to electrically connect to a complementary electrical component such as a substrate 42 which is illustrated as a printed circuit board. The substrate 42 can be provided as a backplane, midplane, daughtercard, or the like. The receptacle mating ends 46 are configured to electrically connect to the respective header mating ends 34 of the first electrical connector 22 when the respective mating interfaces 26 and 30 are engaged.

The right angle electrical contacts 44 may have a material thickness of about 0.1 mm to 0.5 mm and a contact height of about 0.1 mm to 0.9 mm. The contact height may vary over the length of the right angle electrical contacts 44. The second electrical connector 24 also may include an IMLA organizer 50 that may be electrically insulated or electrically conductive. An electrically conductive IMLA organizer 50 that retains the IMLAs 40 may be electrically connected to electrically conductive portions of the IMLAs 40 via slits 52 defined in the IMLA organizer 50 or any other suitable connection.

Because the mating interface 30 is substantially perpendicular to the mounting interface 32, the second electrical connector 24 can be provided as a right-angle connector, though it should be appreciated that the first electrical connector can be provided in any desired configuration so as to electrically connect the substrate 42 to the first electrical connector 22. For instance, the second electrical connector 24 can be provided as a receptacle connector or a header connector, and can be arranged as a vertical or mezzanine connector or a right-angle connector as desired. When the connectors 22 and 24 are mounted onto their respective substrates 38 and 42 and electrically connected to each other, the substrates are placed in electrical communication.

Figure 3A:
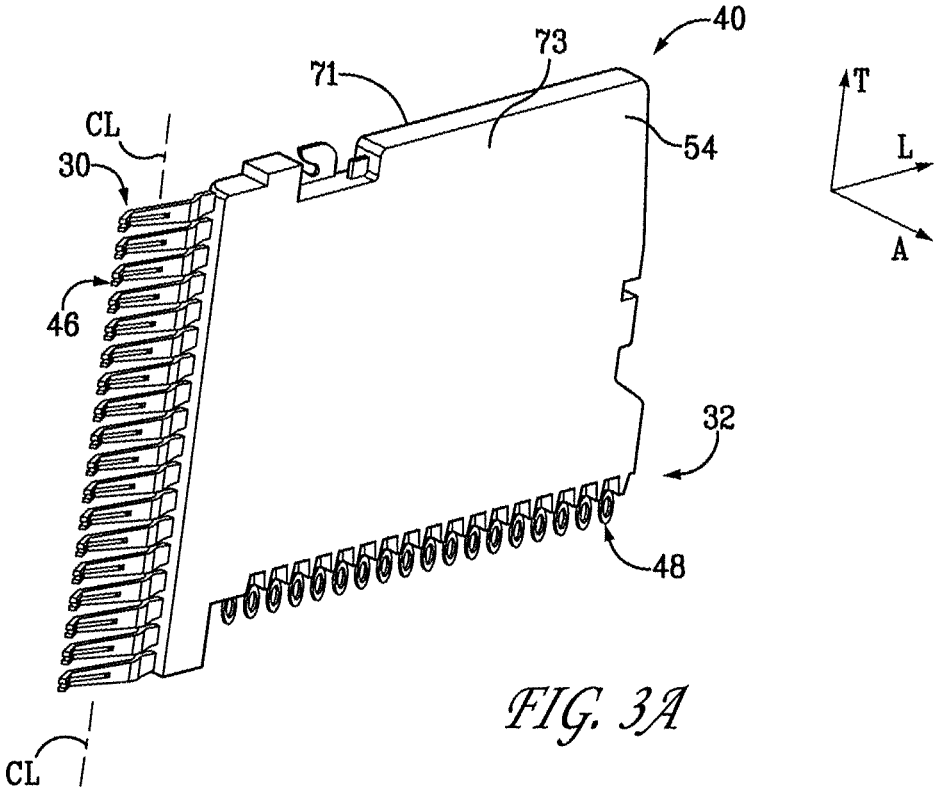
FIG. 3A is a perspective view of one of the IMLAs illustrated in FIGS. 2A-B.
Figure 3B:
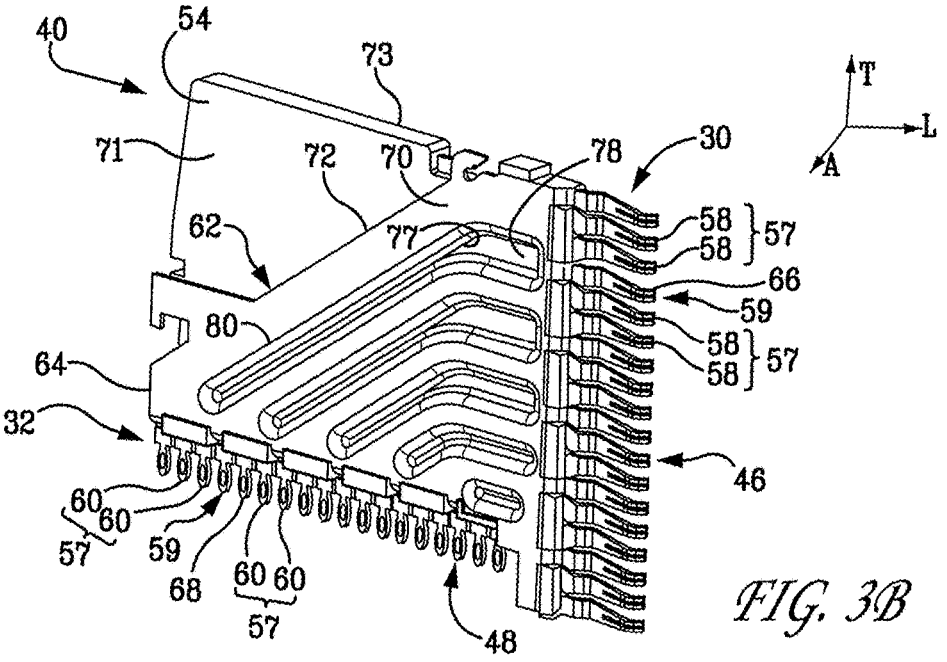
FIG. 3B is another perspective view of the IMLA illustrated in FIG. 3A showing the ground plate.
Figure 3C:
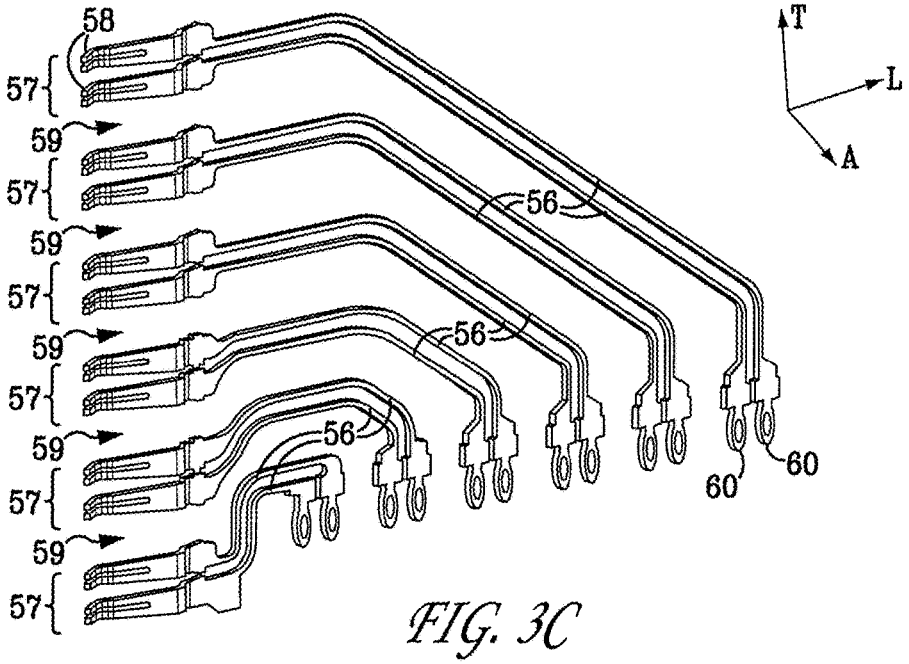
FIG. 3C is a perspective view of the electrical signal contacts of the IMLA illustrated in FIG. 3A, showing the electrical signal contacts arranged as supported by the leadframe housing.

Referring now also to FIGS. 3A-C, Each IMLA 40 includes a leadframe housing 54 which can be provided as a dielectric housing that defines laterally opposed outer surfaces 71 and 73. The leadframe housing can be made of any suitable dielectric material such as plastic, and carries a plurality of electrical signal contacts 56 form right-angle contacts which can be overmolded by the housing 54, or can alternatively can be stitched or otherwise attached in the housing 54. Each signal contact 56 includes a mating end 58 and a mounting end 60. The mating ends 58 of the signal contacts 56 are aligned along the transverse direction T, and the mounting ends 60 of the signal contacts 56 are aligned along the longitudinal direction L. The signal contacts 56 are arranged in pairs 57 (see also FIGS. 6B-C), which can be differential signal pairs. Alternatively, the signal contacts 56 can be provided as single-ended signal contacts. One or more up to all of adjacent pairs 57 of signal contacts 56 are separated by a gap 59.

Figure 4A:
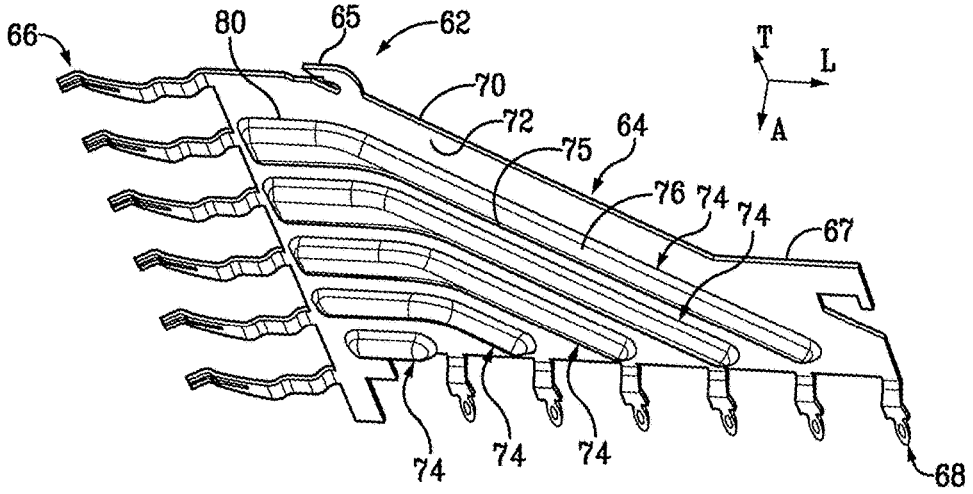
FIG. 4A is a perspective view of the ground plate illustrated in FIG. 3B.
Figure 4B:
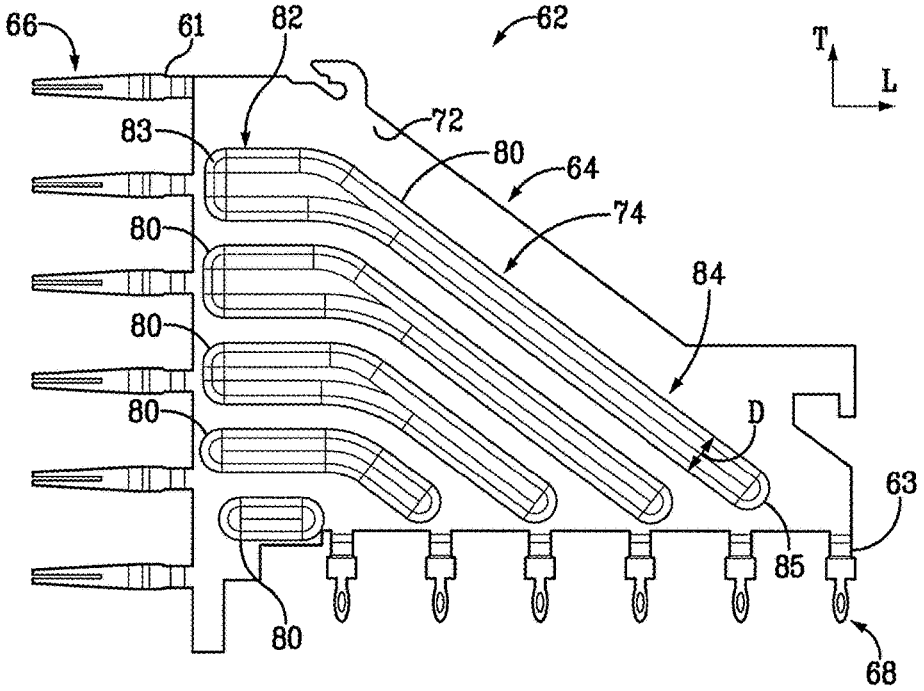
FIG. 4B is a side elevation view of the ground plate illustrated in FIG. 4A.
Figure 5A:
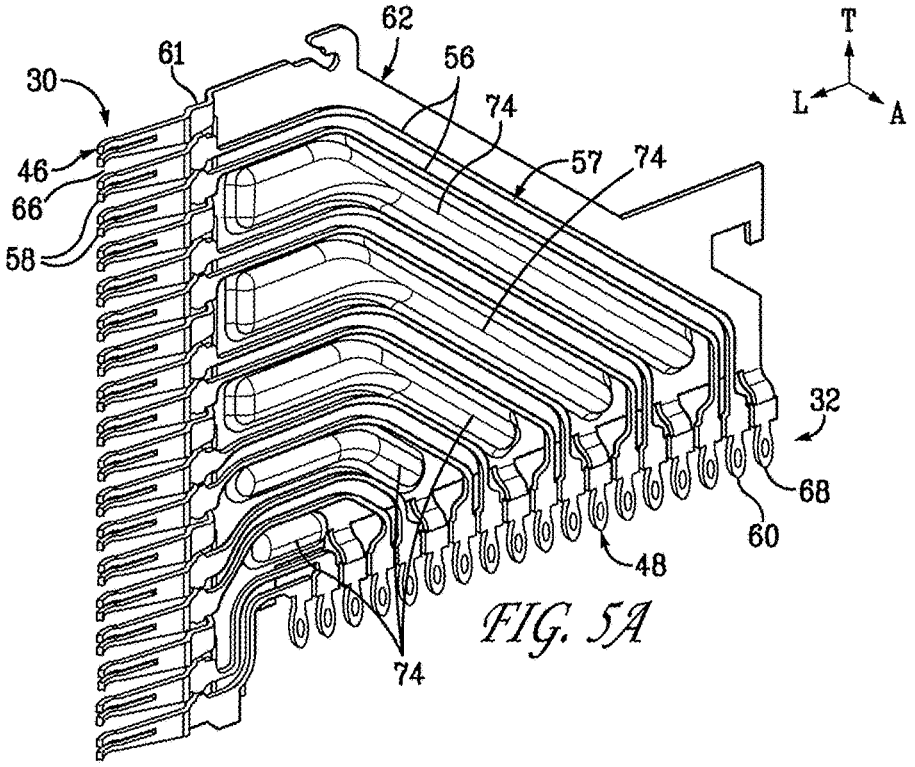
FIG. 5A is a perspective view of the IMLA as illustrated in FIG. 3A but with the leadframe housing removed.
Figure 5B:
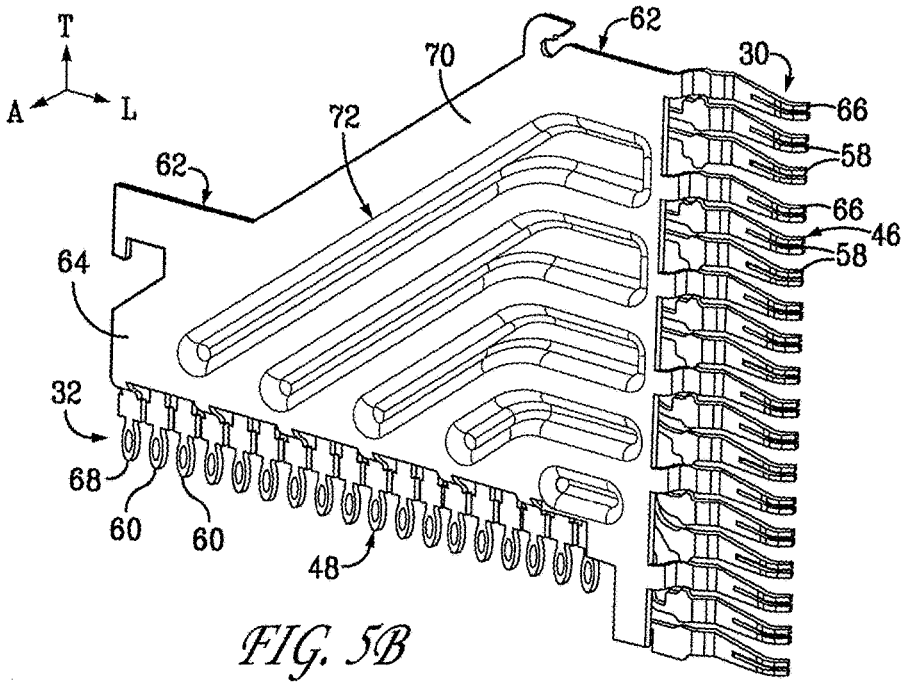
FIG. 5B is a perspective view of the IMLA as illustrated in FIG. 3B but with the leadframe housing removed.

Each IMLA 40 further includes a ground plate 62 that is carried by the leadframe housing 54. The ground plate 62 can be formed from any suitable electrically conductive material, such as a metal, and includes a body 64, a plurality of mating ends 66 extending forward from the body 64, and a plurality of mounting ends 68 extending down from the body. The mating ends 66 and mounting ends 68 can be constructed as described above with respect to the mating ends 58 and 60 of the electrical signal contacts 56. The ground plate 62 can be discretely attached to the housing 54 or overmolded by the housing 54. Referring now also to FIGS. 4A-B, the body 64 of the ground plate 62 defines an inner or first surface 72 and an outer or second surface 70 that is laterally opposed with respect to the inner surface 72. The outer surface 70 can be flush with, can protrude past, or can be inwardly recessed with respect to the corresponding outer surface 71 of the leadframe housing 54. Accordingly, the dimensions of the electrical connector 24 can remain unchanged with respect to electrical connectors whose IMLAs carry discrete ground contacts, for instance as described in U.S. Pat. No. 7,497,736, the disclosure of which is hereby incorporated by reference as if set forth in its entirety herein. The inner surface 72 faces the electrical signal contacts 56 of the IMLA 40. The ground plate 62 can further include at least one engagement member configured to attach to the organizer, such as upper or first hook 65 and a rear or second hook 67.

The ground plate 62 can be electrically conductive, and thus configured to reflect electromagnetic energy produced by the signal contacts 56 during use, though it should be appreciated that the ground plate 62 could alternatively be configured to absorb electromagnetic energy. For instance the ground plate 62 can be made from one or more ECCOSORB® absorber products, commercially available from Emerson & Cuming, located in Randolph, Mass. The ground plate 62 can alternatively be made from one or more SRC Polylron® absorber products, commercially available from SRC Cables, Inc, located in Santa Rosa, Calif. Furthermore, the ground plates 62 are disposed between the signal contacts 56 of adjacent IMLAs, the ground plates 62 can provide a shield that reduces cross-talk between signal the signal contacts 56 of adjacent IMLAs 40.

The mating ends 66 of the ground plate 62 define ground mating ends, while the mounting ends 68 of the ground plate 62 define ground mounting ends. The mating ends 66 are aligned along the transverse direction T, and are further aligned with the mating ends 58 along the transverse direction T. The mounting ends 68 are aligned along the longitudinal direction L, and are aligned with the mounting ends 60 along the longitudinal direction L. The mating ends 66 are positioned adjacent and/or between pairs 57 of mating ends 58, and the mounting ends 68 are positioned adjacent and/or between pairs of mounting ends 60. Thus, the mating ends 46 of the electrical connector 24 include both the mating ends 58 and the mating ends 66, and the mounting ends 48 of the electrical connector 24 include both the mounting ends 60 and the mounting ends 68.

In accordance with the illustrated embodiment, the mating ends 66 of the ground plate 62 are disposed in the gap 59 that extends between adjacent pairs 57 of mating ends 58, such that the mating ends 46, which includes mating ends 58 and 66, are equidistantly spaced along the mating interface 30 of the electrical connector 24. Likewise, the mounting ends 68 of the ground plate 62 are disposed in the gap 59 that extends between adjacent pairs of mounting ends 60, such that the mounting ends 48, which includes the mounting ends 60 and 68, are equidistantly spaced along the mounting interface 32 of the electrical connector 24.

The pairs 57 of electrical signal contacts 56 may be differential signal pairs, or the signal contacts 56 can be provided as single-ended contacts. The signal contacts 56 are positioned edge-to-edge along a common centerline CL. Six differential signal pairs 57 are illustrated, however the connector 24 can include any number of differential signal pairs extending along the centerline CL, such as two, three, four, five, six, or more.

Referring now to FIGS. 4A-5B, the ground plate 62 includes at least one rib 74, such as a plurality of ribs 74 supported by the plate body 64. In accordance with the illustrated embodiment, each rib 74 is stamped or embossed into the body 64, and is thus integral with the body 64. Thus, the ribs 74 can further be referred to as embossments. As illustrated, each rib 74 defines a first surface 75 that defines a projection 76 extending laterally inwardly (e.g., into the IMLA 40) from the inner surface 72, and an opposed second surface 77 that defines a corresponding divot 78 or recessed surface extending into the outer surface 70 of the ground plate body 64. Otherwise stated, the body 64 includes a plurality of projections 76 projecting laterally from the inner surface, and further includes a plurality of divots 78, corresponding to the plurality of projections 76, recessed in the outer surface 70. The ribs 74 define respective enclosed outer perimeters 80 that are spaced from each other along the ground plate body 64. Thus, the ribs 74 are fully contained in the plate body 64.

The ribs 74 define a front or first portion 82 disposed proximate to the mating ends 66, and a rear or second portion 84 that is disposed proximate to the mounting ends 68. The front and rear portions 82 and 84 define a respective front or first terminal end 83, and a rear or second terminal end 85. The ribs 74 thus define a length extending between the first end second terminal ends 83 and 85. As illustrated, the ribs 74 can have different lengths along the ground plate body 64. For instance, those ribs 74 disposed at an upper or first end of the ground plate body 64 are longer than the ribs 74 that are disposed at a lower or second end of the ground plate body 64. In accordance with the illustrated embodiment, the length of each ribs 74 decreases along a direction from the upper or first end to the lower or second end of the ground plate body 64.

The ribs 74 can extend along a direction that includes one or more of a horizontal or longitudinal direction, a vertical or transverse direction, and an angled direction having both longitudinal and transverse directional components. For instance, as illustrated, the front portions 82 of some of the ribs 74 extend along a longitudinal rearward or direction from a location proximate to the mating ends 66 to the rear portion 84. The rear portion 84 extends along a second direction that is laterally rearward and transversely down from the front portion 82 to a location proximate to the mounting ends 68. The rear portion 84 extends at an angle between 90° and 180° with respect to the front portion 82. It should be appreciated that one or more of the ribs 74, for instance the bottommost rib 74 shown in FIG. 4B, extends only longitudinally. It should be further appreciated that one or more of the ribs 74 can further extend along a third transverse direction, for instance at a location proximate to the mounting ends 68.

Referring now to FIGS. 4A-6C, the electrical signal contacts 56 are aligned or arranged in a first transverse-longitudinal plane T-L1 that includes the common centerline CL, and the ground plate body 64 is oriented in a second transverse-longitudinal ground plane T-L2 that extends substantially parallel to the first plane T-L1, and is laterally outwardly offset or spaced from the first plane T-L1. The projection 76 of each rib 74 extends laterally inward from the inner surface 72 of the ground plate body 64 toward the first plane T-L1. The projections 76 can extend laterally from the inner surface 72 a distance sufficient such that a portion of each projections 76 extends into the first plane T-L1 and is thus co-planar with the signal contacts 56 (or a portion of the signal contacts 56), but less than the thickness of the leadframe housing 54 such that the projections 76 are recessed with respect to the outer surface 73 (see FIG. 3B). The projections 76 are aligned with the gaps 59 disposed between adjacent pairs 57 of signal contacts 56, such that the portion of each projection 76 that extends into the first plane T-L1 between adjacent pairs 57 is disposed in a corresponding one of the gaps 59.

The ground plate 62 includes a first neck 61 extending between the ground plate body 64 and each mating end 66, and a second neck 63 extending between the ground plate body 64 and each mounting end 68. In particular, each first neck 61 extends laterally inward from the second plane T-L2 toward the first plane T-L1 along a longitudinally forward direction from the ground plate body 64, such that the mating ends 66 lie in the first plane T-L1 and are thus co-planar with the mating ends 58 of the signal contacts 56. Likewise, the second neck 63 extends laterally inward from the second plane T-L2 toward the first plane T-L1 along a transversely downward direction from the ground plate body 64, such that the mounting end 68 lies in the first plane T-L1, and is thus co-planar with the mounting ends 60 of the signal contacts 56.

Each rib 74 defines a cross-sectional distance D that extends along the second plane T-L2 in a direction normal to the outer perimeter 80. The distance D can be consistent along the length of a given rib 74, as illustrated in the lowermost rib 74 shown in FIG. 4A. Alternatively, the distance D can vary along the length of a given rib between the front and rear ends 83 and 85, respectively. For instance, the distance D can be smaller at the rear portion 84 than at the front portion 82. Otherwise stated, the distance D can increase along the length of the rib 74 from the rear portion 84 to the front portion 82. Likewise, the gap 59 disposed between adjacent pairs 57 of signal contacts 56 can increase along a direction from the mounting ends 60 toward the mating ends 58 so as to accommodate the increasing cross-sectional distance D of the ribs 74.

Figure 6A:
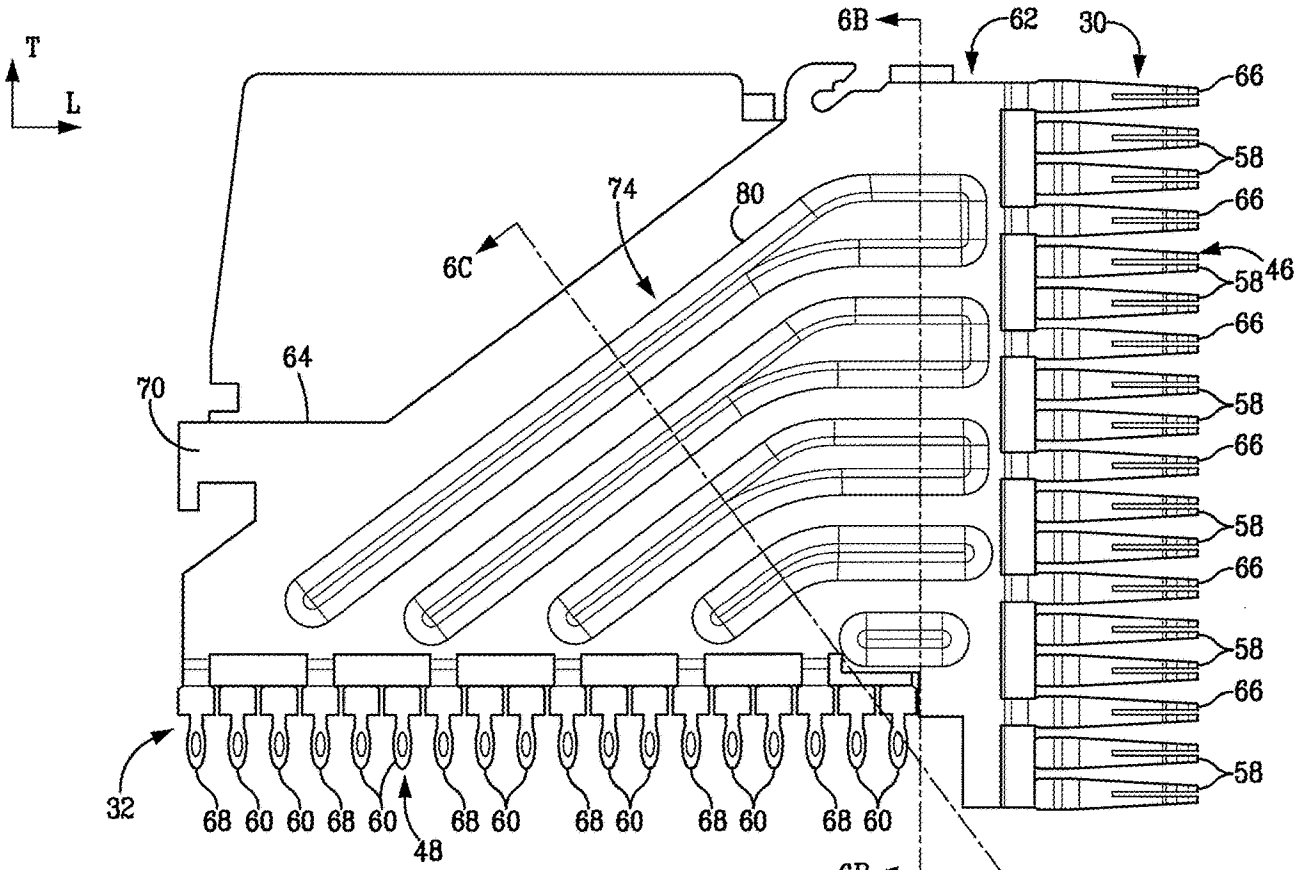
FIG. 6A is a side elevation view of the IMLA illustrated in FIG. 3B.
Figure 6B:
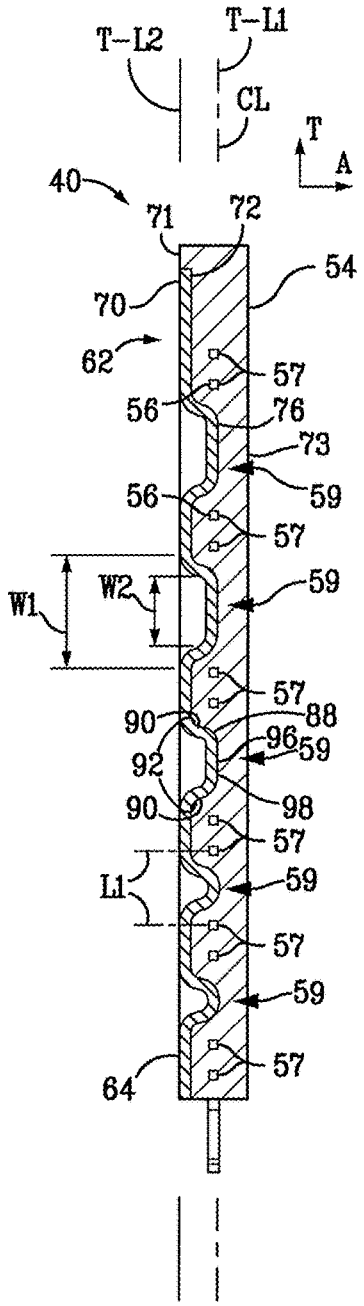
FIG. 6B is a sectional view of the IMLA illustrated in FIG. 6A, taken along line 6B-6B.
Figure 6C:
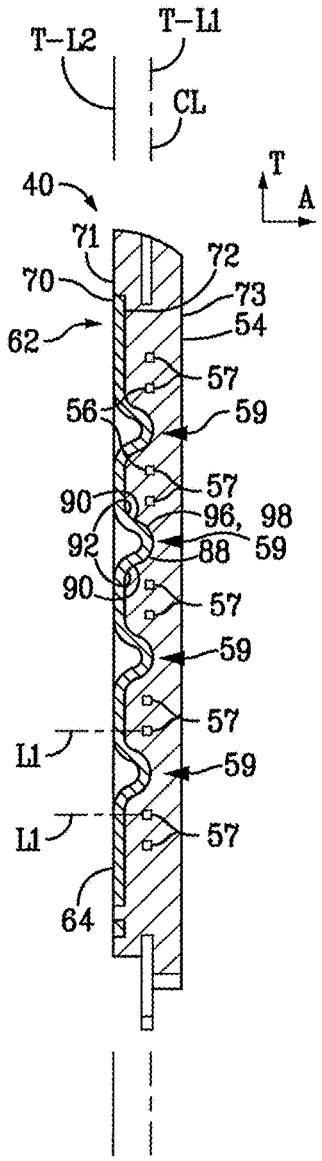
FIG. 6C is a sectional view of the IMLA illustrated in FIG. 6A, taken along line 6C-6C.

With continuing reference to FIGS. 4A-6C, and in particular to FIGS. 6B-C, each rib 74 can include at least one wall 88. The wall 88 includes opposed outer wall portions 90 that each extend laterally from the inner surface 72 at the outer perimeter 80, and can converge toward each other along their direction of extension from the inner surface 72. When the ground plate 62 is installed in the IMLA, the outer wall portions 90 extend into a corresponding one of the gaps 59 between adjacent pairs 57 of signal contacts 56. As illustrated, the outer wall portions 90 can be beveled or curved. Furthermore, the curvature of each rib 74 can vary along its length. The outer wall portions 90 define from a proximal end 92 of the rib 74, and terminate at a middle wall portion 96 that is connected between the outer wall portions 90. The proximal end 92 of the rib 74 is the portion of the rib 74 that extends from the inner surface 72 at a location proximate to the inner surface 72.

The middle wall portion 96 is thus disposed at a location that is laterally offset with respect to the inner surface 72 of the ground plate body 64. In accordance with the illustrated embodiment, the middle wall portion 96 defines a distal end 98 of the rib 74 that lies in the first plane T-L1. The middle wall portion 96 can include a curved portion along a direction extending normal to the signal contacts 56 that define the corresponding gap 59, or can alternatively or additionally include a flat portion along a direction extending normal to the signal contacts 56 that define the gap 59. In this regard, it should be appreciated that the middle wall portion 96 can alternatively be entirely curved along a direction extending normal to the signal contacts 56 that define the corresponding gap 59, or entirely flat along a direction extending normal to the signal contacts 56 that define the gap 59. Thus, the ribs 74 can define curvatures that vary from each other. It should thus be appreciated that the ribs 74 can be curved or tapered, and thus devoid of sharp edges that are out of plane T-L1 with respect to the differential signal contacts 56. Furthermore, each rib 74 can be spaced at a consistent distance along its length from its adjacent signal contacts 56 that define the corresponding gap 59. Moreover, each rib 74 can be spaced from its adjacent signal contacts 56 a distance that is substantially equal to the distance that one or more up to all of the other ribs 74 are spaced from their adjacent signal contacts.

While the middle wall portion 96 can lie in the first plane T-L1 as illustrated, it should be appreciated that the rib 74 could alternatively terminate at the distal end 98 which is positioned inward of, or past, the first plane T-L1. In accordance with the illustrated embodiment, the middle wall portion 96 extends at substantially a constant lateral distance LD from the inner surface 72 of the ground plate 62 that is substantially equal to the lateral distance between the second plane T-L2 and the first plane T-L1.

It should be appreciated that a portion of each rib 74 can overlap the electrical signal contacts 56 that define the corresponding gap 59 with respect to an axis extending through the signal contacts 56 in a direction perpendicular to and between the first and second planes T-L1 and T-L2. Alternatively, the ribs 74 can be wholly contained between the axes extending through the signal contacts 56 in a direction perpendicular to and between the first and second planes T-L1 and T-L2. For instance, In accordance with the illustrated embodiment, the proximal end 92 of each rib 74 is positioned inward with respect to the corresponding signal contacts 56 that define the gap 59. Accordingly, a lateral axis L1 that extends through the proximal ends 92 one or more ribs 74 also extends through the corresponding gap 59, and not one of the signal contacts 56 that defines the gap 59. Alternatively, the proximal ends 92 could be disposed outward or inline with respect to the corresponding signal contacts 56 that define the gap 59. Accordingly, the lateral axis Ll that extends through the proximal ends 92 or other locations of the rib 74 can also extend through one or both signal contacts 56 that defines the corresponding gap 59.

With continuing reference to FIGS. 4A-6C, each rib 74 can define a first width W1 extending along a direction parallel to the ground plate plane T-L2 at the proximal end 92, and a second width W2 extending along the direction parallel to the ground plate plane T-L2 at the distal end 98 that is less than the first width W1 in accordance with the illustrated embodiment. The widths W1 and W2 of at least one rib 74 can be less than, greater than, or substantially equal to one or both of the corresponding widths W1 and W2 of one or more of the other ribs 74.

Figure 8:
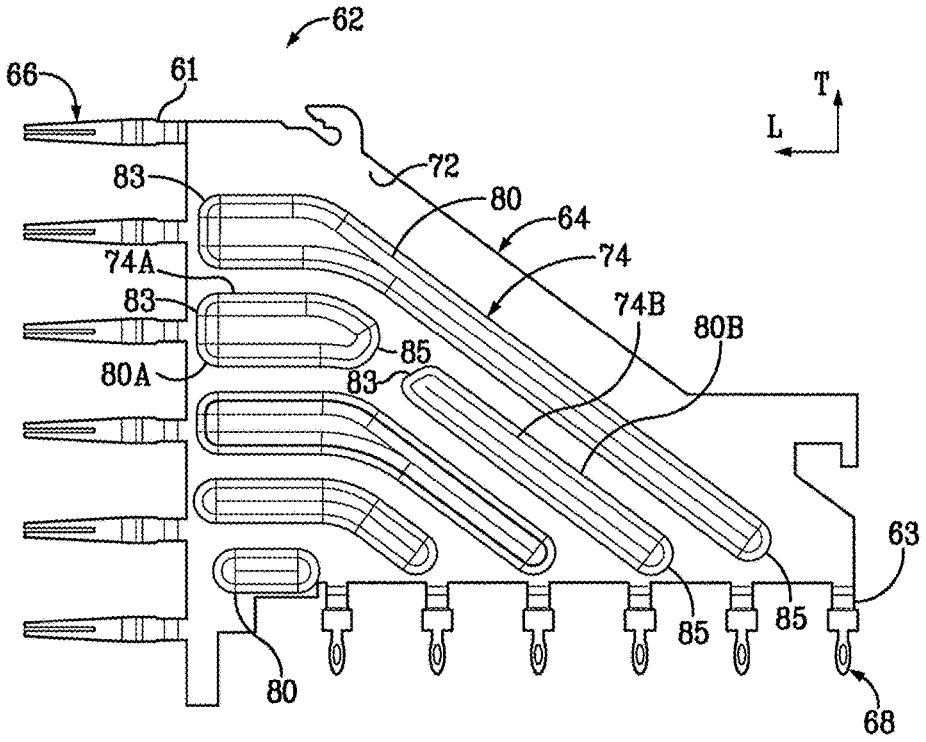
FIG. 8 is a side elevation view of a ground plate similar to the ground plate illustrated in FIG. 4B, but constructed in accordance with an alternative embodiment.

While the ribs 74 are illustrated as extending continuously from their respective front end 83 to their rear ends 85, it should be appreciated that one or more up to all of the ribs 74 can be discontinuous or segmented between the front and rear ends 83 and 85. For instance, as illustrated in FIG. 8, one or more the ribs 74 can be provided as separate rib segments 74*a* and 74*b*, each defining respective enclosed perimeters 80*a* and 80*b* spaced from each other between the corresponding mating end 66 and mounting end 68. Alternatively or additionally, the middle wall portion 96 of a given rib 74 can project a distance from the inner surface 72 that varies along the length of the rib 74 between the front end 83 and the rear end 85.

While FIGS. 6B-C show the leadframe housing 54 overmolded onto the signal contacts 56 and the ground plate 62, it should be appreciated that the signal contacts 56, the ground plate 62, or both the signal contacts 56 and the ground plate 62 can be discreetly attached to the leadframe housing 54. Furthermore, while the ground plate 62 is shown as abutting the leadframe housing 54 along its length, the ground plate 62 can alternatively be supported by the leadframe housing 54 at discrete locations of the ground plate 62, such that one or more air gaps are disposed between the housing 54 and the ground plate 62 and desired locations. For instance, an air gap between the leadframe housing 54 and the ribs 74 would allow for clearance of the ribs 74 when the ground plate 62 is attached to the leadframe housing 54. It should be further appreciated that such air gaps could further be provided when the leadframe housing 54 is overmolded onto the ground plate 62. Likewise, while the signal contacts 56 are shown as abutting the leadframe housing 54 along their length, the signal contacts 56 can alternatively be supported by the leadframe housing 54 at discrete locations of the signal contacts 56, such that air gaps are disposed between the housing 54 and the signal contacts and desired locations. It should be further appreciated that such air gaps could further be provided when the leadframe housing 54 is overmolded onto the signal contacts 56.

Figure 7A:
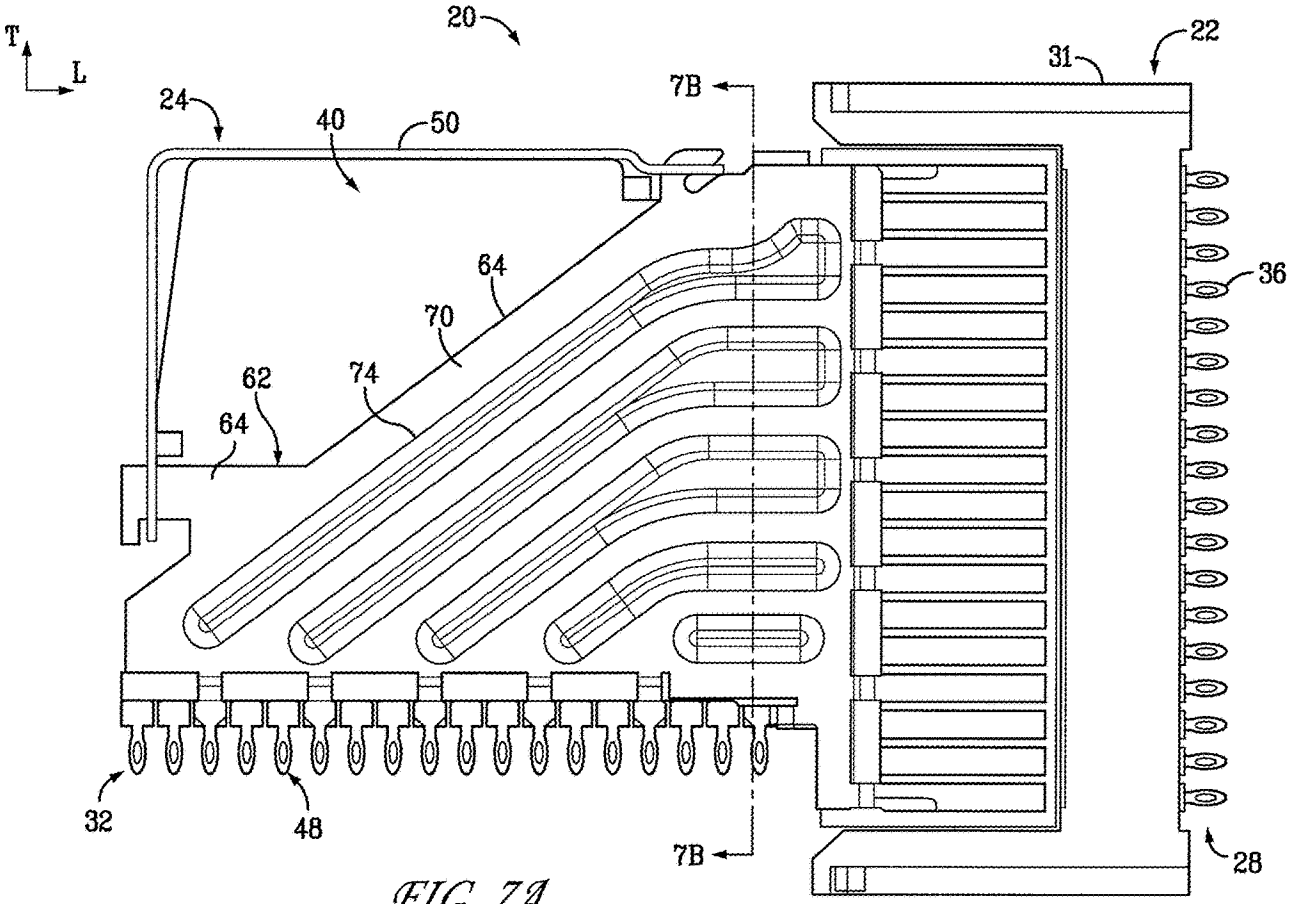
FIG. 7A is a side elevation view of the electrical connector assembly as illustrated in FIG. 2B.
Figure 7B:
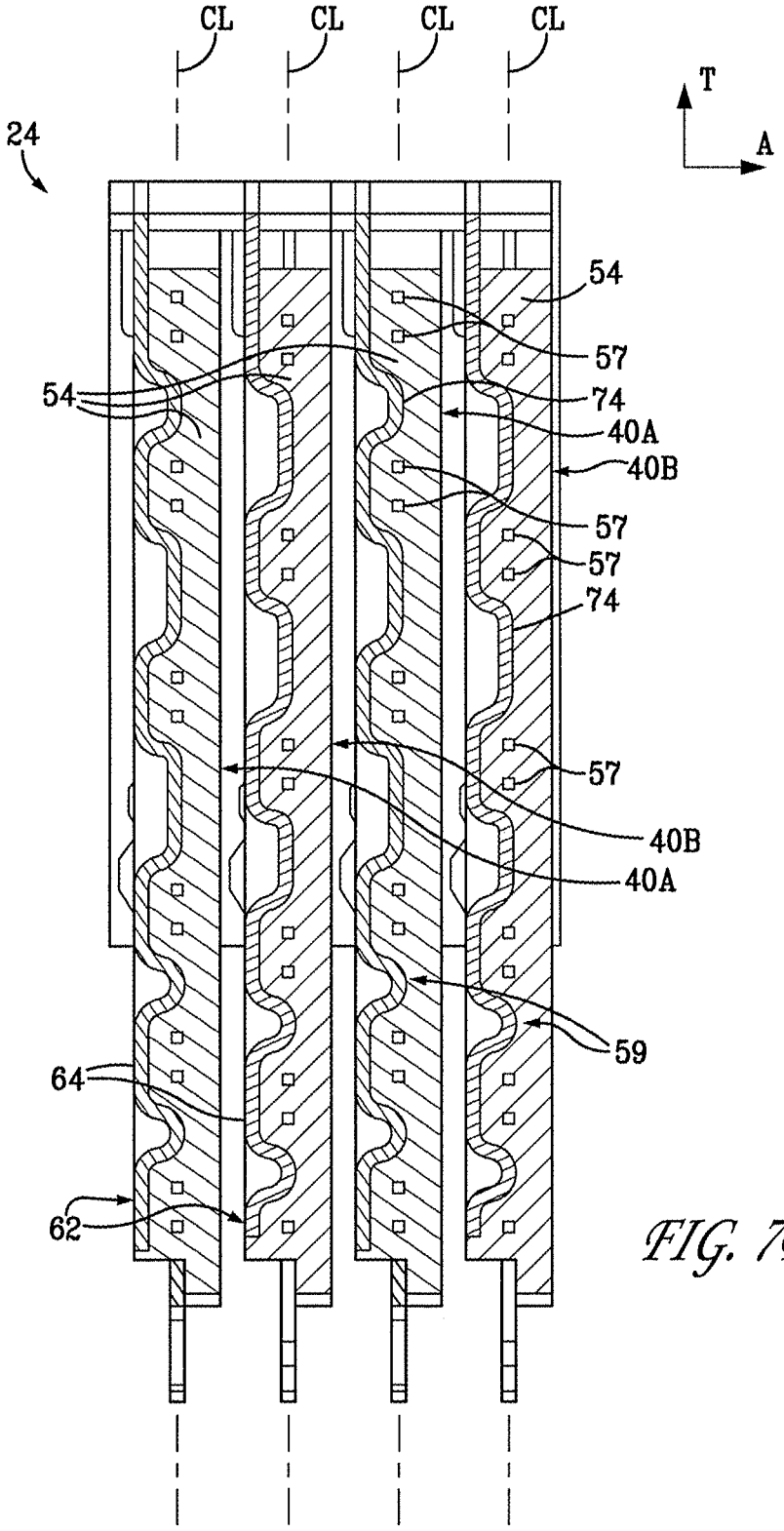
FIG. 7B is a sectional view of the electrical connector assembly illustrated in FIG. 7A, taken along line 7B-7B.

Referring now to FIGS. 7A-B, the electrical connector 24 is illustrated as including a plurality of IMLAs 40 of the type described above. Four IMLAs 40 are illustrated having electrical contacts 44 that extend along respective common centerlines CL, though it should be appreciated that the connector 24 can include as many IMLAs 40 as desired. Each IMLA can include as many electrical signal contact pairs 57 and interleaved ribs 74 as desired. Thus, one or more up to all of the IMLAs 40 can include a ground plate 62 of the type described above. The IMLAs 40 include a first-type of IMLAs 40A that are substantially identically constructed and a second type of IMLAs 40B that substantially identically constructed. The IMLAs 40A and 40B are alternately arranged along the lateral direction A. In accordance with the illustrated embodiment, the signal contacts 56 of the first IMLAs 40A are staggered with respect to the signal contacts 56 of the second IMLAs 40B. Accordingly, the gaps 59 between adjacent signal pairs 57 of the first IMLAs 40*a* are staggered with respect to the gaps 59 of the second IMLAs 40B. It should be appreciated that the mating ends 66 and mounting ends 68 can extend from any position along the ground plate body 64 as desired, such that the mating ends 66 are disposed between and aligned with the mating ends 58 of the signal contacts 56 in the manner described above, and the mounting ends 68 are disposed between and aligned with the mounting ends 60 of the signal contacts 56 in the manner described above.

For instance, in accordance with one embodiment, the mating ends 46 of the first IMLAs 40A are arranged in a repeating G-S-S-G-S-S pattern in a direction along the common centerline CL from the top of the mating interface 30 toward the bottom of the mating interface 30, whereby "G" denotes electrical ground contact mating ends 66 and "S" denotes electrical signal contact mating ends 58. Furthermore, in accordance with one embodiment, the mating ends 46 of the second IMLAs 40B are arranged in a repeating S-S-G-S-S-G pattern in a direction along the common centerline CL from the top end of the mating interface 30 toward the bottom of the mating interface 30, whereby "G" denotes electrical ground contact mating ends 66 and "S" denotes electrical signal contact mating ends 58.

It should thus be appreciated that a method of producing an electrical connector includes the steps of 1) providing a plurality of electrical signal contacts 56, 2) retaining the electrical signal contacts 56 in the leadframe housing 54 along the first plane T-L1 so as to define gaps 59 disposed between adjacent pairs of electrical signal contacts 56, 3) providing a ground plate 62 having a ground plate body 64 that defines first and second opposed surfaces 72 and 70, respectively, 4) stamping a plurality of ribs 74 into the second surface 70 of the ground plate body 64 such that the ribs 74 define first and second opposed surfaces 75 and 77, respectively, wherein the first surface 75 of each rib 74 projects out from the first surface 72 of the ground plate body 64, and the second surface 77 of each rib is recessed in the second surface 70 of the ground plate body 64, and 5) attaching the ground plate 62 to the leadframe housing 54 such that the ground plate body 64 is oriented in the second plane T-L2 that is offset with respect to the first plane T-L1, and the first surface 75 of each rib 74 projects toward a respective one of the gaps 59 defined by the adjacent pairs 57 of electrical signal contacts 56.

The ground plate 62 is a wide continuous conductor, and is wider than the ground contacts of an electrical connector that is substantially identical with respect to the electrical connector 24, with the exception that the substantially identical electrical connector does not include the ground plate 62, but instead includes discrete ground contacts extending in the gaps 59 that define opposing ground mating ends and ground mounting ends as described in U.S. Pat. No. 7,497,736. Accordingly, it should be appreciated that the electrical connector 24 can be modified with respect to substantially identical electrical connector, with the exception that the electrical connector 24 is devoid of discrete ground contacts in favor of the ground plate 62 having ribs 74 that extend between adjacent pairs 57 of signal contacts 56. Thus, the electrical connector 24 is an improvement over shieldless, high density, right-angle electrical connectors that have discrete ground contacts without significantly lowering impedance matching and without significantly increasing inductance. In accordance with embodiments of the present invention, the impedance of the electrical connector 24 is not significantly altered with respect to a pre-modified connector, inductance of the electrical connector 24 is lower than the ground contacts in the same pre-modified connector, crosstalk of the electrical connector 24 is lower as compared to the same pre-modified connector, and the overall dimensions of the electrical connector 24 are the same as those of the pre-modified connector.

For instance, it is believed that the ground plate 62 provides a low-impedance common path that intercepts and dissipates stray electro-magnetic energy between signal contacts 56 that otherwise would have been a source for cross talk. It is believed that a connector that incorporates the IMLAs 40 as described above can operate at 13 GHz with acceptable worst-case, multi-active crosstalk on a victim pair of no more than six percent, for instance less than one percent, such as 0.4 percent. Worst case, multi-active crosstalk may be determined in the manner described in U.S. Pat. No. 7,497,736.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Those skilled in the relevant art, having the benefit of the teachings of this specification, may effect numerous modifications to the invention as described herein, and changes may be made without departing from the spirit and scope of the invention as defined by the appended claims.

What is claimed is:

1. An electrical connector comprising:

a dielectric housing;

a plurality of electrical signal contacts that are carried by the dielectric housing, and that are arranged along a first plane that extends along both a first direction, and a second direction that is perpendicular to the first direction, wherein the electrical signal contacts define respective mating ends, respective mounting ends, and electrical signal pairs;

a ground plate carried by the dielectric housing, the ground plate including a ground plate body oriented in a second plane that is substantially parallel to the first plane and offset from the first plane, the ground plate body defining first and second opposed surfaces, and the ground plate including a plurality of ribs that are contained in the ground plate body and that define first and second opposed surfaces, wherein the first surfaces of the ribs project from the first surface of the ground plate body in a direction toward the first plane, the second surfaces of the plurality of ribs are recessed into the second surface of the ground plate body; and a plurality of ground mounting ends disposed between mounting ends of adjacent electrical signal pairs, wherein the ground mounting ends are electrically coupled to the ground plate, wherein the plurality of ground mounting ends are disposed in the respective gaps in the first plane aligned with the mounting ends of the electrical signal contacts and offset from the ground plate body, wherein the electrical signal pairs comprise differential pairs and the plurality of ribs are positioned between respective adjacent differential pairs.

2. The electrical connector as recited in claim 1, wherein the dielectric housing is a leadframe housing over molded onto the electrical signal contacts.

3. The electrical connector as recited in claim 2, wherein the ground plate is discretely attached to the leadframe housing.

4. The electrical connector as recited in claim 1, wherein at least one rib of the plurality of ribs is embossed into the ground plate and the at least one rib defines a curved outer wall portion.

5. The electrical connector as recited in claim 1, further comprising a plurality of ground mating ends disposed between mating ends of adjacent electrical signal pairs, wherein the ground mating ends are electrically coupled to the ground plate.

6. The electrical connector as recited in claim 5, wherein the plurality of ground mating ends are offset from the ground plate body so as to extend in the respective gaps in the first plane aligned with the mating ends of the electrical signal contacts.

7. The electrical connector as recited in claim 1, wherein at least one rib of the plurality of ribs extends along a length that is different with respect to at least one other rib of the plurality of ribs.

8. The electrical connector as recited in claim 7, wherein each of the at least one rib and the at least one other rib of the plurality of ribs has a portion that is disposed in the first plane, and the portion of the at least one rib that is disposed in the first plane has a curvature that is different than the portion of the at least one other rib of the plurality of ribs disposed in the first plane.

9. The electrical connector as recited in claim 1, wherein at least one rib of the plurality of ribs is segmented.

10. The electrical connector as recited in claim 1, wherein the electrical signal contacts are right-angle contacts.

11. The electrical connector as recited in claim 1, wherein the plurality of ribs function as ground contacts between respective adjacent differential pairs.

12. The electrical connector as recited in claim 1, wherein at least a portion of at least one of the plurality of ribs extends along a direction that is angularly offset with respect to the first and second directions.

13. The electrical connector as recited in claim 6, wherein at least one of the ground mounting ends is in line with at least one of the plurality of ribs along the first direction.

14. An electrical connector comprising:

an organizer; and a plurality of insert molded leadframe assemblies retained by the organizer, each insert molded leadframe assembly comprising:

a dielectric housing;

a plurality of electrical signal contacts carried by the dielectric housing and arranged along a first plane that extends along both a first direction, and a second direction that is perpendicular to the first direction, wherein the signal contacts are arranged in pairs, the signal contacts defining respective mating ends and mounting ends; and a ground plate carried by the dielectric housing, the ground plate including a ground plate body oriented in a second plane that is substantially parallel to the first plane and offset from the first plane, the ground plate body defining first and second opposed surfaces, the ground plate comprising:

a plurality ribs that are each embossed in the ground plate, that are each fully contained in the ground plate body, and that each define first and second opposed surfaces, wherein the first surface of each rib projects from the first surface of the ground plate body in a direction toward the first plane, and the second surface is recessed into the second surface of the ground plate body;

wherein the electrical signal pairs comprise differential pairs and the plurality of ribs are positioned between respective adjacent differential pairs;

wherein the plurality of insert molded leadframe assemblies includes a first type of insert molded leadframe assembly and a second type of insert molded leadframe assembly alternately arranged, wherein the signal contacts of the first type of insert molded leadframe assembly are staggered with respect to the signal contacts of the second type of insert molded leadframe assembly.

15. The electrical connector as recited in claim 14, wherein each rib takes place of a ground contact between the adjacent pairs of signal contacts.

16. The electrical connector as recited in claim 14, wherein at least a portion of at least one of the ribs extends along a direction that is angularly offset with respective to the first and second directions.

17. An electrical connector comprising:

a dielectric housing;

a plurality of electrical signal contacts that are carried by the dielectric housing, and that are arranged along a first plane that extends along both a first direction, and a second direction that is perpendicular to the first direction, wherein the electrical signal contacts define respective mating ends, respective mounting ends, and electrical signal pairs;

a ground plate carried by the dielectric housing, the ground plate including a ground plate body oriented in a second plane that is substantially parallel to the first plane and offset from the first plane, the ground plate body defining first and second opposed surfaces, and the ground plate including a plurality of ribs that are contained in the ground plate body and that define first and second opposed surfaces, wherein the first surfaces of the ribs project from the first surface of the ground plate body in a direction toward the first plane, the second surfaces of the plurality of ribs are recessed into the second surface of the ground plate body; and a plurality of ground mating ends disposed between mating ends of adjacent electrical signal pairs, wherein the ground mating ends are electrically coupled to the ground plate, wherein the plurality of ground mating ends are disposed in the respective gaps in the first plane aligned with the mating ends of the electrical signal contacts and offset from the ground plate body, wherein the electrical signal pairs comprise differential pairs and the plurality of ribs are positioned between respective adjacent differential pairs.

18. The electrical connector as recited in claim 17, wherein at least one rib of the plurality of ribs is embossed into the ground plate and the at least one rib defines a curved outer wall portion.

* * * * *